US008347897B2

(12) United States Patent
Benest et al.

(10) Patent No.: US 8,347,897 B2
(45) Date of Patent: Jan. 8, 2013

(54) APPARATUS FOR HOT AND COLD PROCESSING

(75) Inventors: Roger Sydney Benest, St. Helier (GB); Richard Gilmore, St. Ouen (GB)

(73) Assignee: Hot-Stixx Limited, London (GB)

( * ) Notice: Subject to any disclaimer, the term of this patent is extended or adjusted under 35 U.S.C. 154(b) by 70 days.

(21) Appl. No.: 12/747,213

(22) PCT Filed: Dec. 10, 2008

(86) PCT No.: PCT/GB2008/004066

§ 371 (c)(1),
(2), (4) Date: Oct. 7, 2010

(87) PCT Pub. No.: WO2009/074788

PCT Pub. Date: Jun. 18, 2009

(65) Prior Publication Data

US 2011/0056509 A1 Mar. 10, 2011

(30) Foreign Application Priority Data

Dec. 10, 2007 (GB) ..... 0723970.0

(51) Int. Cl.
*A45D 1/00* (2006.01)
*A45D 2/40* (2006.01)

(52) U.S. Cl. ..... 132/224

(58) Field of Classification Search ..... 132/227–229; 219/225; 34/97; 165/201, 272, 61, 64, 138; 62/3.2–3.3, 3.7
See application file for complete search history.

(56) References Cited

U.S. PATENT DOCUMENTS

| | | | | |
|---|---|---|---|---|
| 3,420,247 | A | 1/1969 | Seagrave | |
| 4,011,104 | A * | 3/1977 | Basiulis | 136/205 |
| 4,297,564 | A | 10/1981 | Bartolac | |
| 4,448,028 | A * | 5/1984 | Chao et al. | 62/3.3 |
| 5,223,694 | A * | 6/1993 | Tsuji et al. | 219/225 |
| 5,412,535 | A * | 5/1995 | Chao et al. | 361/700 |
| 5,507,103 | A | 4/1996 | Merritt | |
| 5,584,307 | A * | 12/1996 | Bauer et al. | 132/113 |
| 5,868,146 | A | 2/1999 | Henninger et al. | |
| 6,354,016 | B1 | 3/2002 | Cafaro | |
| 7,509,998 | B1 * | 3/2009 | Rodney | 165/201 |

(Continued)

FOREIGN PATENT DOCUMENTS

| | | |
|---|---|---|
| CH | 669319 | 3/1989 |

(Continued)

OTHER PUBLICATIONS

NPL amendment dated Jul. 25-Jul. 27, 2012.*

(Continued)

*Primary Examiner* — Rachel Steitz
*Assistant Examiner* — Jennifer Gill
(74) *Attorney, Agent, or Firm* — Harness, Dickey & Pierce, P.L.C.

(57) ABSTRACT

The invention relates to an apparatus for hot and cold processing (1), the apparatus comprising: a heat pump (74) configured to pump heat from a first part of the heat pump to a second part of the heat pump, thereby cooling the first part of the heat pump for cold processing (73); a first heat sink (72) arranged to be in thermal contact with the second part of the heat pump such that heat may be transferred from the second part of the heat pump to the first heat sink and thereby cool the second part of the heat pump.

18 Claims, 23 Drawing Sheets

U.S. PATENT DOCUMENTS

| | | | | |
|---|---|---|---|---|
| 7,926,198 | B2 * | 4/2011 | Merritt | 34/96 |
| 7,989,734 | B2 * | 8/2011 | Lee | 219/222 |
| 2003/0052115 | A1 * | 3/2003 | Leung | 219/222 |
| 2003/0111877 | A1 | 6/2003 | Collins et al. | |
| 2005/0126184 | A1 * | 6/2005 | Cauchy | 62/3.3 |
| 2006/0207625 | A1 * | 9/2006 | Chan | 132/224 |
| 2007/0166208 | A1 * | 7/2007 | Tanaka et al. | 422/186.04 |
| 2008/0216859 | A1 | 9/2008 | Chan | |
| 2009/0084396 | A1 * | 4/2009 | Jerome et al. | 132/224 |

FOREIGN PATENT DOCUMENTS

| | | | |
|---|---|---|---|
| DE | 3215232 | A1 | 10/1983 |
| EP | 0400381 | A2 | 12/1990 |
| GB | 2069834 | | 9/1981 |
| GB | 2459507 | A * | 4/2008 |
| JP | 6221738 | A | 8/1994 |
| JP | 6335407 | A | 12/1994 |
| JP | 7049157 | A | 2/1995 |
| JP | 9224736 | A | 9/1997 |
| JP | 2000-201723 | | 7/2000 |
| WO | WO-2006099522 | A2 | 9/2006 |
| WO | WO-2007000700 | A2 | 1/2007 |

OTHER PUBLICATIONS

UK Search Report under Section 17 for GB0711931.6.
International Preliminary Report on Patentability, incorporating the Written Opinion of the ISA.

* cited by examiner

APPARATUS FOR HOT AND COLD PROCESSING

CROSS-REFERENCE TO RELATED APPLICATIONS

This application is a 371 U.S. National Stage of International Application No. PCT/GB2008/004066, filed Dec. 10, 2008. This application claims the benefit of United Kingdom Patent Application No. 0723970.0, filed Dec. 10, 2007. The disclosures of the above applications are incorporated herein by reference.

The present invention relates to an apparatus for hot and cold processing, for example during hair styling. The apparatus uses a heat pump, such as a Peltier device or thermoelectric cooler (TEC) to produce a source of cooling which can be used to cool hair.

BACKGROUND

In many areas of industry it is required that materials are heated and cooled rapidly. Example industries include plastic reforming, motor body repairs, clothing repairs and manufacturer, plastic leisure goods, marine industries and the hairdressing industry. The general practice is to heat a range of materials reform or shape the material or article and then rapid cool to maintain the shape.

For hairdressing, the state of the art goes back 50 and more years it has been known that applying gentle heat to the hair follicles produces a change in the chemical makeup of the hair follicle.

In the case of hair tongs and straightening tongs, advances have been made in the mariner by which the heat is transmitted to the hair by the heating element with the express purpose of heating the full cross section in the shortest time to avoid damage. It is a fact that applying high heat to the hair can destroy it or damage it. In recent times manufacturers have steadily increased the temperature of their irons up to 230 degrees centigrade. This particular high heat iron became popular until women complained about damage to their hair. The inventors of the following devices and technology set about refining and developing the method by which heat is introduced to the hair. It is a known fact that heating the hair changes the hydrogen bonds within the follicle. A challenge was to define the correct or most suitable temperature to which hair may be heated.

It is also known in the art that cooling hair after it has been heated and formed into a desired style helps set the style, so that the hair maintains the style for a longer period of time.

In the case conventional of hair dryers, arrangements provide for rapid heating of hair by a heated air stream, whilst cooling is provided by switching off the heating elements placed in a driven air steam.

However, at best the "cool" air provided by these dryers is the same temperature as the ambient air. More commonly, the cool air is actually warmer than the ambient air, because it has been contaminated by residual heated air produced whilst the heating element cools down.

As such, the rate at which hair can be cooled (which is determined by the temperature difference between the hair and the cooling medium) is limited when using conventional apparatuses. In the case of hair tongs, it is known to use the casing of the hair tongs to cool hair after it has been in contact with the heated element of the tongs. However, once again, the casing is certainly no cooler than the ambient conditions and is likely to be much hotter due to heat leakage from the heated plates (although the casing may still be cooler than the plates themselves).

Therefore, it is desirable to incorporate a method of active cooling into hair styling devices, so that hair can be both quickly heated and quickly cooled. The active cooling would not only allow for lower cooling temperatures to be achieved, but would also allow for the cooling effect to be more rapidly available. That is, there would be no need to wait for a heating element to cool down before a cool stream of air could be achieved. At present, it is common for hairdressers to forgo the cooling function of conventional hair dryers in favour of manually blowing on hair which has been heated and put into a shape, in order to cool the hair down. This is because the cooling function of the conventional hair dryers does not provide suitably cool air fast enough after the hair dryer has produced heated air.

One way of cooling is to use the thermoelectric effect to create a temperature difference across a device constructed from suitable materials by applying an electric voltage across the device. This is also known as the Peltier effect, and devices making use of the Peltier device are commonly referred to as Peltier modules. Because these devices are most often used to produce a source of cooling (as opposed to a source of heating) these devices are also known as thermoelectric coolers (TECs).

Previous patents teach the use of Peltier modules mounted in hair irons to provide heat and or hot and cold. In WO 2007/00700 A2 there is described a device whereby quote:

"A preferred kind of coolers based on the Peltier effect, so-called thermoelectric coolers (TEC). TEC's usually having a cold and hot side. Particularly compact hair styling appliances can be achieved, if the cooling member is the cold side of a TEC and the heating member is the hot side of a TEC."

U.S. Pat. No. 5,507,103 discloses a hair dryer which utilises the thermoelectric effect. A Peltier device is positioned in a conduit, such that air flowing over one side of the Peltier device is cooled, whilst air flowing over the other side is heated. Therefore, existing hair styling devices do not heat and cool a lock of hair efficiently, resulting in costly delays for professional hairdressers in time wasted between heating and cooling operations.

SUMMARY OF INVENTION

According to a first aspect of the present invention, there is provided an apparatus for hot and cold processing, the apparatus comprising: a heat pump device configured to pump heat from a first part of the heat pump device to a second part of the heat pump device, thereby cooling the first part of the heat pump device for cold processing; a first heat sink arranged to be in thermal contact with the second part of the heat pump device such that heat may be transferred from the second part of the heat pump device to the first heat sink and thereby cool the second part of the heat pump device. The invention also relates to an apparatus for cooling or cold processing only. In that case, the hot processing would be carried out by a separate apparatus. For example, during hair styling hot processing could be carried out by a conventional hair dryer and cold processing by an apparatus of the present invention.

According to this aspect of the invention, a heat sink is provided on the hot side of the heat pump, to remove heat from the hot side of the heat pump. The provision of a large heat sink means that the hot side of the heat pump is kept relatively cool because the heat is transferred away efficiently.

By keeping the hot side of the heat pump at a relatively cool temperature, the cold side of the heat pump can be cooled to an even cooler temperature. Therefore, the apparatus of the present invention allows for the temperature of the cold side of the heat pump to be reduced at least to ambient conditions, and preferably to a temperature lower than the ambient conditions.

In some embodiments the apparatus is for styling hair. The cold source can be used to cool hair very rapidly, after it has been heated. This ensures that the style which has been created when the hair is hot is maintained for a long time in the hair after cooling.

In some embodiments, the apparatus further comprises at least one heat pipe for one of either transferring heat from the second part or transferring heat to the first part of the heat pump. In some embodiments, the first heat sink is in thermal contact with the second part of the heat pump via the at least one heat pipe. In some embodiments, the apparatus may further comprise a component arranged in thermal contact with the first part of the heat pump, such that the heat is transferred from the component to the first part of the heat pump. The apparatus may be further arranged such that the first part is in thermal contact with the component via at least one heat pipe.

These embodiments represent different ways in which the invention may be implemented to gain different advantages. Heat pipes are heat transfer mechanisms that can transport large quantities of heat with a very small difference in temperature between the hotter and colder interfaces. When an apparatus in accordance with the present invention is arranged with one end of a heat pipe in contact with the second (i.e. hot) part of the heat pump, and the other end of the heat pipe in contact with the first heat sink, the heat pipe acts to transfer heat from the second part of the heat pump to the first heat sink.

This arrangement allows for efficient transfer of heat to the heat sink, but also allows for the heat pump to be located in a position spatially remote from the heat sink. As such, this allows the efficient transfer of heat away from any component arranged in thermal contact with the first part (i.e. cold part) of the heat pump. This is because the cool side of the heat pump may be positioned very close to the component being cooled.

When the heat pipe is arranged such that it transfers heat to the first part of the heat pump, the heat pump may be arranged spatially close to the first heat sink, but remote from end of the heat pipe absorbing heat. This has the advantage that the heat pump (which may be bulky) does not need to be close to the heat absorbing end of the heat pipe, allowing for the design of the apparatus to be optimised for the heat absorbing use. The heat pump device can be located anywhere within the apparatus which is convenient.

In some embodiments, the apparatus further comprises a unit for causing a first gas stream to flow across the first heat sink and thereby transfer heat from the first heat sink to the first gas stream. This allows for forced gas cooling of the heat sink. The forced convection removes heat from the heat sink, lowering the temperature of the heat sink and therefore lowering the temperature of the second (hot) part of the heat pump which enables lower temperatures to be achieved on the first (cold) side of the heat pump. In some embodiments, the heat absorbed by the first air stream is disposed of as waste heat In some embodiments, the first unit is configured such that the first gas stream does not transfer heat to the first part of the heat pump. This is advantageous because the heat removed the first (cold) part of the heat pump is removed in order to cool that part. Therefore, it is not desirable to force gas over the heat sink and also the cooled side of the heat pump, and thereby return heat to the first (cold) part.

A lack of gas flow on the first (cold) part of the heat pump also allows for the cold part to be cooled to a lower temperature more quickly than if a gas was flowing and transferring heat to the first (cold) part of the heat pump.

The first unit may comprise a fan arranged to cause the first gas stream to flow across the first heat sink.

In some embodiments, the first heat sink comprises a plurality of fins, preferably wherein the plurality of fins are shaped to guide the first gas stream out of the apparatus. The provision of fins on the heat sink increases the surface area for heat transfer, and thereby dissipates heat from the heat sink more quickly, thereby improving the cooling. If the fins are shaped to guide the first gas stream out of the apparatus, it is ensured that the heat will not directly return to the cool side of the heat pump.

In some embodiments the surface area of the first heat sink is at least thirty times greater than the surface area of the second part of the heat pump. A large surface area is required on the heat sink in order to dissipate enough heat to allow the efficient operation of the heat pump. A surface area ratio of 30:1 between the surface of the heat sink and the surface area of the second part of the heat pump (which is in thermal contact with the heat sink).

In some embodiments, the apparatus is for cold processing at a temperature of from 8° C. to 20° C., and preferably from 12° C. to 15° C. These ranges of temperatures are typically below the ambient temperature in which hair styling occurs. As such, these temperatures provide a large driving force for cooling the hair (after it has been heated), and thereby sets the hair in the formed style very quickly. It is not desirable to cool hair to lower temperatures, because at that point condensation could form in the hair. It is known that moisture can negate the effect of shaping and styling hair, leading to the hair losing its shape. Therefore, it is not desirable to get condensation in the hair when styling it. Other apparatuses for use in other applications may require other temperature ranges.

In some embodiments the apparatus is for hot processing at a temperature from 90° C. to 160° C., and preferably from 110° C. to 140° C. These temperature ranges provide sufficient heat to re-shape hair. The heat required to shape hair varies depending on the condition of the hair, the type of hair and any other treatments which have been applied to the hair. However, previous devices have heated hair as high as 230° C. and this is known to damage hair in some cases, especially if the exposure to heat is prolonged. According to the present invention, because instant cooling at or below the ambient temperature is available, it is not necessary to heat hair to such high temperatures because the hair can be cooled much more quickly. Other apparatuses for use in other applications may require other temperature ranges.

In some embodiments the apparatus further comprises a heater for providing a source of heat. A separate heater to the hot side of the heat pump is used to ensure that hot enough temperatures can be achieved. Because, according to the present invention, the hot side of the heat pump is being maintained at a low temperature (in order to obtain an even lower temperature on the cold side) the hot side of the heat pump is not hot enough to provide the heat required for styling and shaping hair.

In some embodiments the heat pump is a thermoelectric cooler. Thermoelectric coolers or Peltier modules exploit the thermoelectric effect to create a temperature difference from an electric voltage. Such devices are typically compact, which make them suitable for use in the present invention.

In some embodiments the apparatus is hair tongs. Hair tongs (also known as straightening irons) are commonly used to heat hair up in order to straighten the hair. Hair tongs may also be used in order to provide some shaping or curling to hair.

In some embodiments the component of the hair tongs is a first element with a surface for contacting with hair. This element may be some form of plate, disposed near the end of the tongs. As already discussed, in some embodiments it may be desirable to locate the heat pump near this component (i.e. in the end of the tongs), or in other embodiments it may be desirable to locate the heat pump remote to the end of the tongs (i.e. near the hinge).

In some embodiments the tongs further comprise a second element which has a surface for contacting hair. This element is for being heated, and is used for providing the heat to the hair being styled. The first element is then used to remove the heat from the hair and set the style which has been created. In some embodiments at least one of the first and second elements is a ceramic plate.

The tongs may comprise two arms pivotally connected to each other (optionally at a hinge), wherein the arms are positionable in a closed position. The first element may be positioned on a first one of the two arms such that the surface for contacting with the hair of the first element faces away from the second one of the two arms when the tongs are in a closed position. In other words, the first (cooled) element may be position on the outer casing of the tongs, and be exposed even when the tongs are in the closed position. Commonly, the heated element(s) of hair tongs are arranged such that the main face of the element is not exposed when the tongs are in a closed position. If the cooled element is provided on the outer surface of the tongs, the heated element may be used to heat hair, which may then be folded back over the outer casing of the tongs, exposing the hair to the cooled element and setting the style.

The tongs may further comprise a magnetic holding device for holding the two arms of the tongs in the closed position. This safety feature ensures that the tongs do not accidentally fall apart, either during use of whilst they are heating up or cooling down. This will avoid the heated elements accidentally coming into contact with objects they are not intended to contact with, avoiding accidentally damage to property and accidentally burns to people. The tongs may also further comprise a mechanism for releasing the two arms from the closed position, overcoming the magnetic hold.

In some embodiments the apparatus is a blow dryer. Blower dryers are commonly used to dry hair by heating the hair. However, it is also desirable to set a style whilst the hair is being dried. Therefore, a cooling provision is desirable in blow dryers.

In some embodiments the blow dryer further comprises a second unit for causing a second gas stream thereby to transfer heat from the second gas stream to the first part of the heat pump and cool the second gas stream. According to these embodiments, the second gas stream is cooled by the first part of the heat pump (either directly or indirectly). The cooled air can then be used for setting the style in the hair. The heat from the second gas stream may be transferred to the first part of the heat pump via a second heat sink which is in thermal contact with the first part of the heat pump. Flowing the second gas stream over the second heat sink removes heat from the gas stream and passes it to the first part of the heat pump, thereby cooling the gas stream.

In some embodiments a heater is positioned in the path of the first gas stream of the blow dryer. The first unit may be arranged to cause the first gas stream to flow over the first heat sink then over the heater or vice versa, thereby heating a first gas stream by removing heat from the first heat sink before heating the first gas stream by removing heat from the heater or vice versa. As such, the first gas stream is heated by both the heater and the first heat sink.

In some embodiments the hair dryer is configured such that the first unit does not cause the first gas stream to flow when the second unit for forcing gas flow causes the second gas stream to flow. According to this embodiment, when the first gas stream is flowing, heat is transferred from the first (cold) side of the heat pump, to the first gas stream via the first heat sink. As such, whilst the first gas stream is flowing, the cold side of the heat pump is cooling (and thereby also cooling any component or heat sink in contact with it). Then, when a cold air stream is required, the second gas stream is caused to flow whilst the first stream is stopped. The second gas stream is cooled (either directly or indirectly) by the first side of the heat pump, and therefore is immediately cold as soon as its starts to flow. Therefore, switching from a hot gas stream to a cold gas stream is instantaneous and no contamination of the cold gas stream with residual heat occurs.

According to another aspect of the present invention there is provided hair tongs, comprising: an element with a surface for contacting hair; a heat sink; a thermoelectric cooler, in thermal contact with the element and the heat sink; configured to transfer heat from the element to the heat sink, thereby cooling the element; and a fan arranged to cause gas to flow over the heat sink, thereby removing heat from the heat sink.

According to another aspect of the present invention there is provided a method of hot and cold processing, the method comprising: pumping heat with a heat pump from a first part of a heat pump to a second part of the heat pump, transferring heat from a component to the first part of the heat pump, thereby cooling the component; transferring heat from the second part of the heat pump to a first heat sink, thereby cooling the second part of the heat pump; selectively forcing gas to flow over either one or the other of the first heat sink or the component, and thereby cause heat transfer between the gas being forced to flow and either the first heat sink or the component.

According to the method aspect of the present invention gas is caused to flow either over a cold side or a hot side of a heat pump, thereby instantaneously providing a hot or cold flow of gas for use in hair styling. Because the gas does not flow over both sides at the same time, the cold side of the heat pump is cooled whilst the gas is flowing over the first side of the heat pump. This allows low temperatures to be achieved on the cold side of the heat pump, which can then be utilised when a cold air stream is required. When the gas flows over the cold side of the heat pump, heat is transferred to the cold side of the heat pump from the gas flowing, thereby cooling the gas. As such, the gas is instantaneously cooled. Therefore, an instantaneous switching from hot to cold flowing gas is obtained.

DESCRIPTION

The invention is described below, by way of example only, with reference to the accompanying drawings, in which.

Figure 13:
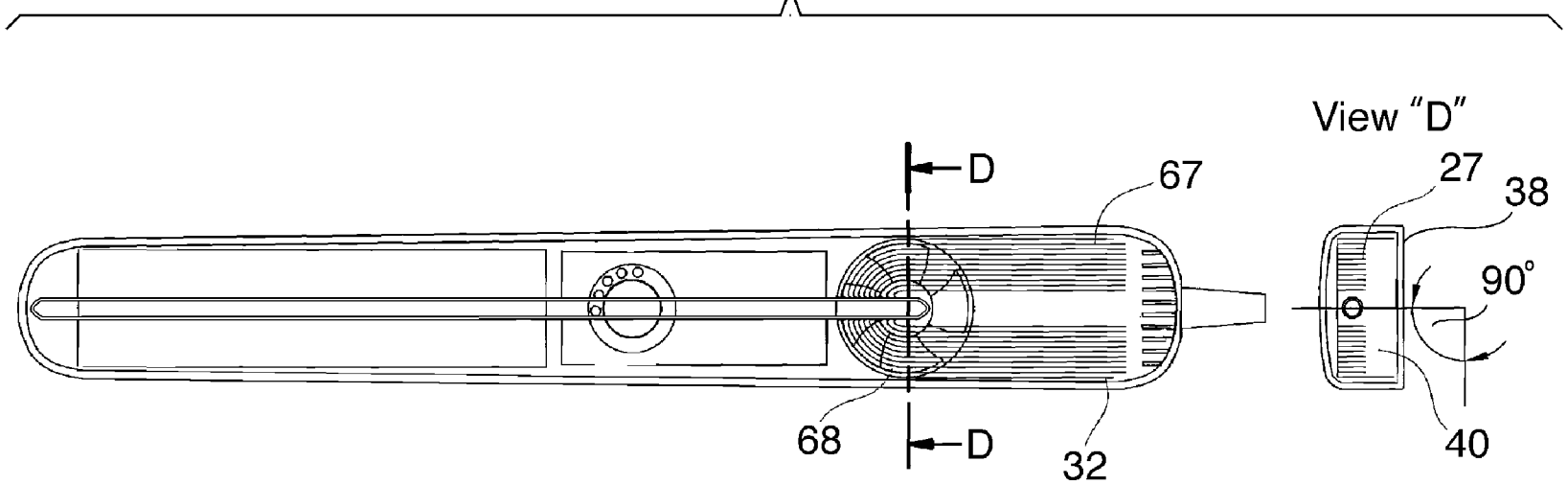
FIG. 13 shows a plan view of one arm of the tongs according to third embodiment of the present invention.
Figure 16:
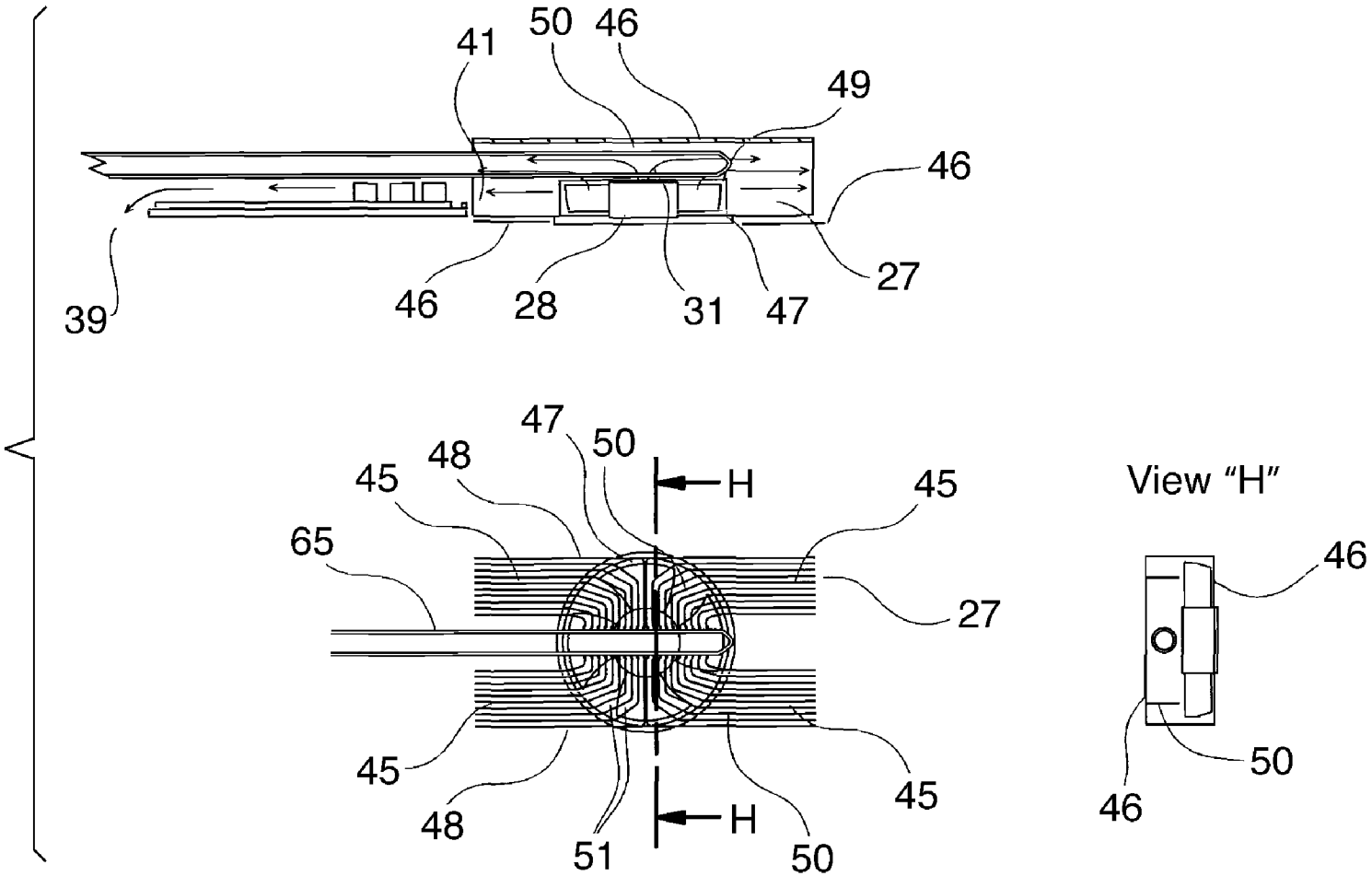
FIG. 16 is s side, plan and end view of an alternative heat sink, for use in the tongs of the third or fourth embodiment of the present invention.
Figure 18:
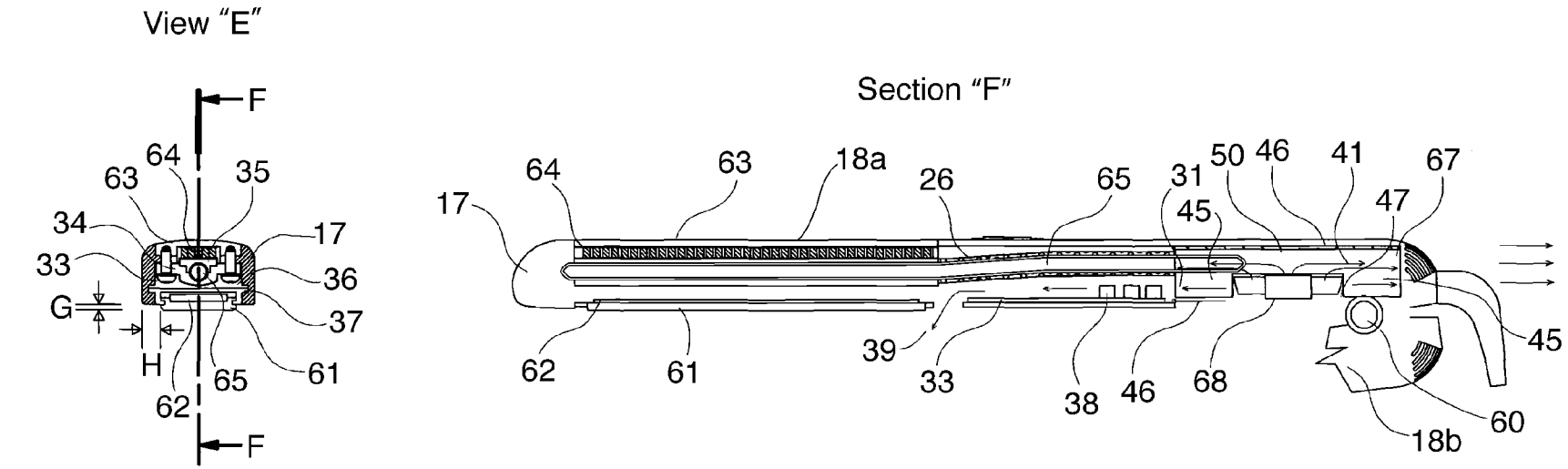
FIG. 18 shows cross-sectional views through tongs corresponding to the tongs of FIG. 12 incorporating the heat sink shown in FIG. 16
Figure 18A:
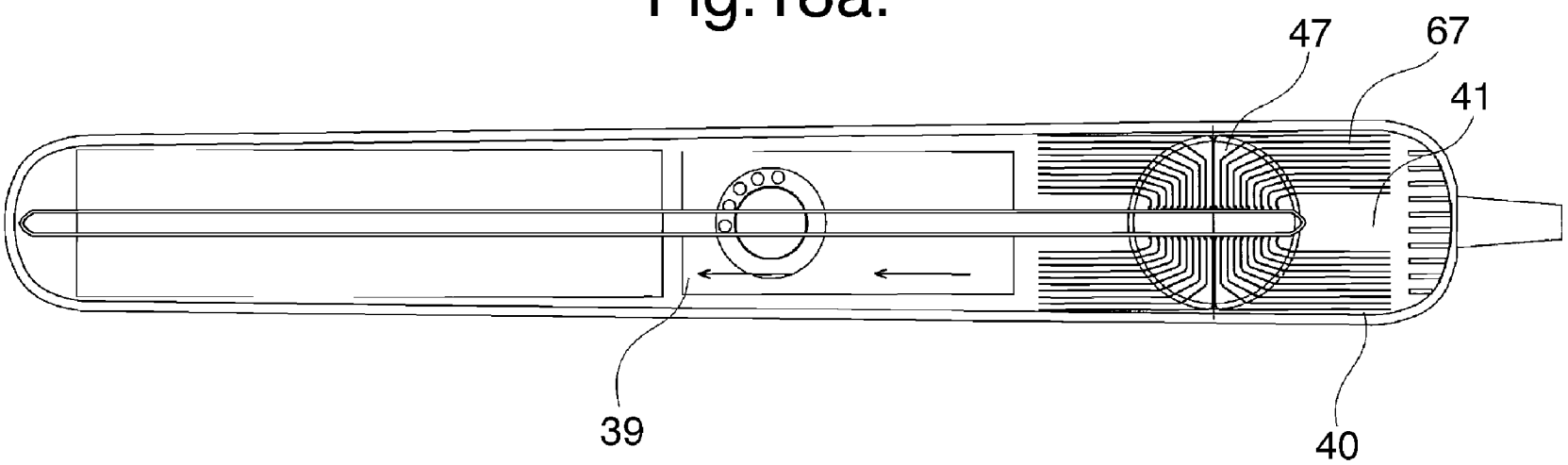
Figure 19:
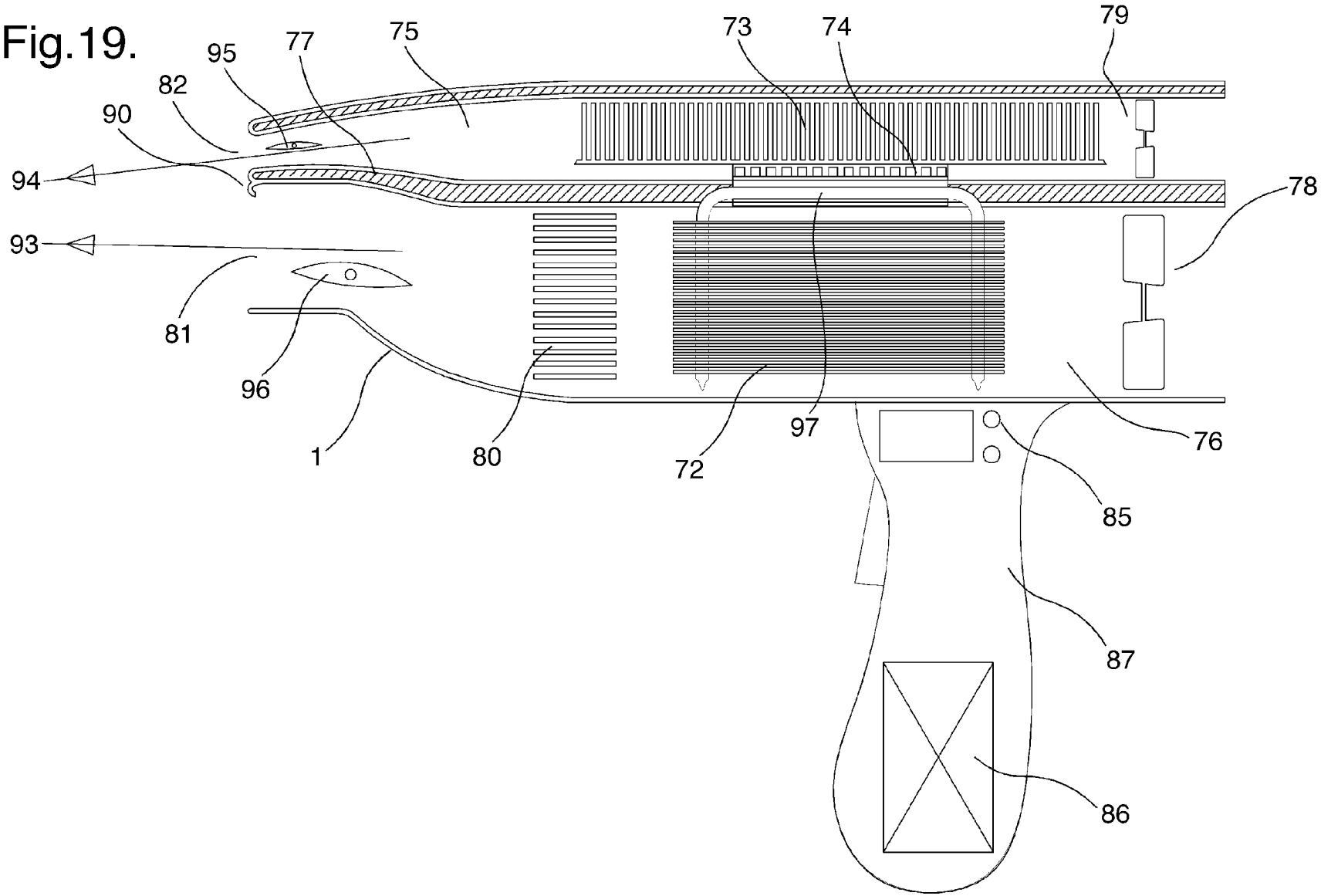
Figure 20:
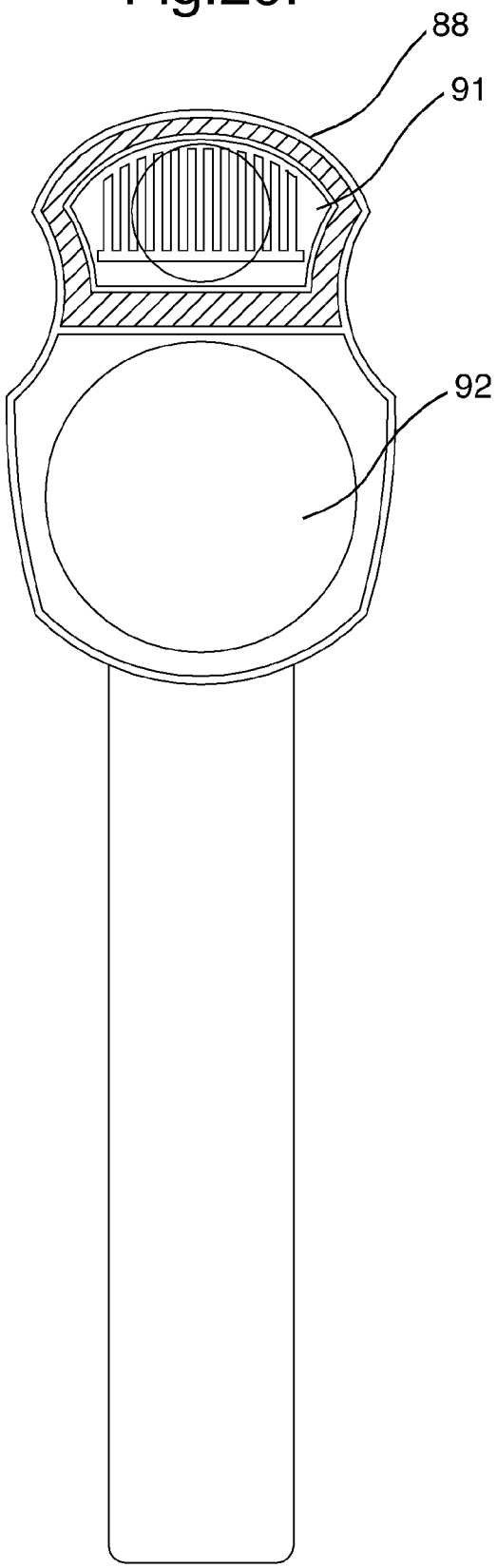
Figure 21:
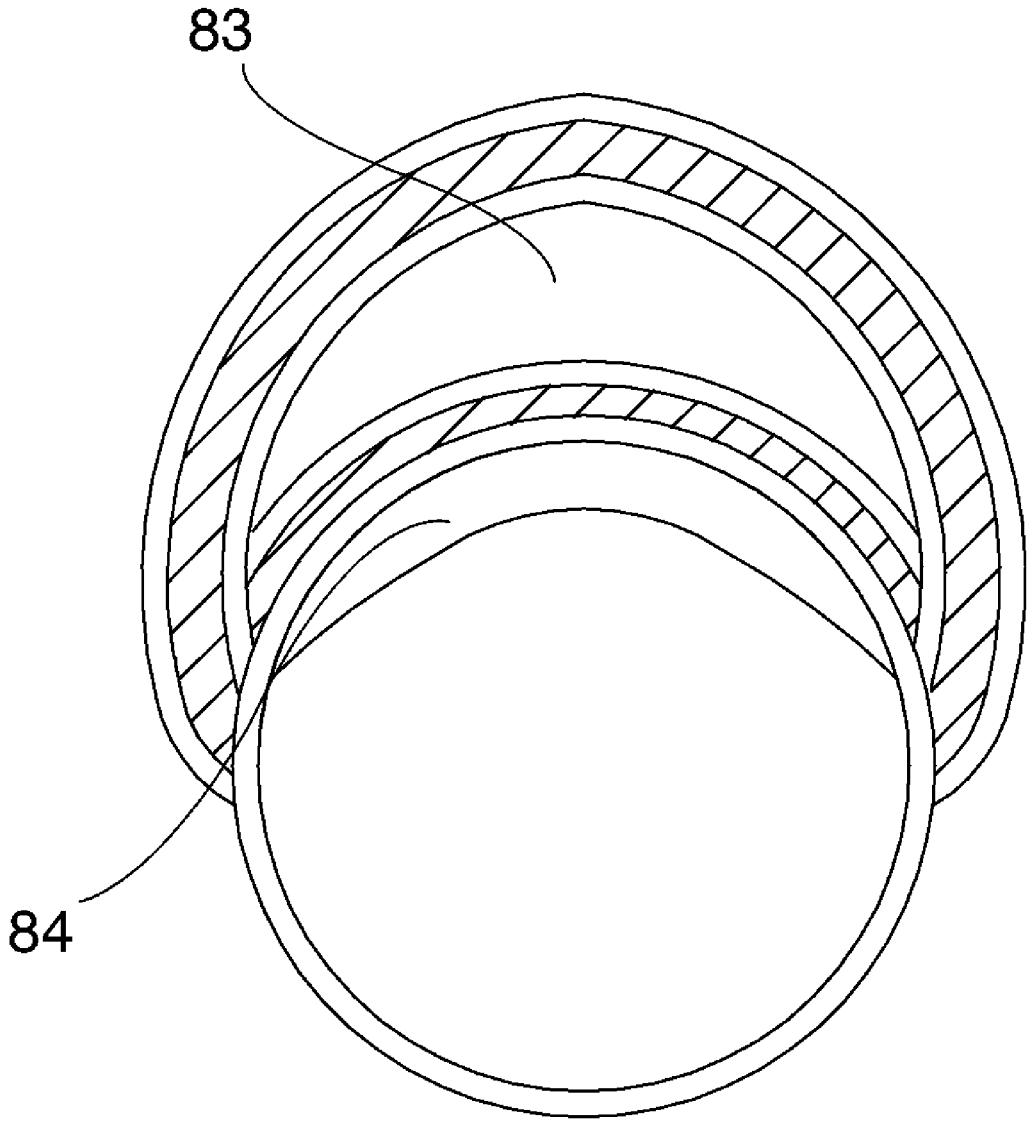

FIG. 18*a* shows a plan view of one arm of tongs corresponding to the tongs of FIG. 13 incorporating the heat sink shown in FIG. 16;

FIG. 19 shows a schematic diagram of a hair dryer in accordance with a fifth embodiment of the invention;

FIG. 20 shows a schematic diagram of a back view of the hair dryer of FIG. 19; and FIG. 21 shows a close up schematic diagram of a front view of the nozzle of the dryer of FIG. 19.

The following description and embodiment make particular reference to applications in the field of hairdressing. The invention can also be applied to apparatuses for use in other fields.

The inventors of prior art devices, such as that discussed in WO 2007/00700 have not appreciated that the TEC/Peltier Module is simply the pumping device, and to put it to use in the described manner would not work. This is because a Peltier module can only transfer heat from one junction or position to another.

To enable any capacity of cooling to be provided a large heat sink is required to evaporate the waste heat recovered from the object placed on the reverse side of the TEC in the aforementioned case the cold platen. Given the very small surface required for the described use in WO 2007/00700 the TEC would not achieve the desired results. Also a TEC may work efficiently with the temperature differential either side of the TEC at 60 degrees Centigrade. In the described WO 2007/00700 A2 the inventor does not make provision for this additional equipment and does not demonstrate how two similar platens can carry out the hot and cold services required for the TEC to operate efficiently when it is generally understood that the size ratio should be in the region of 30-1.

Research has shown that to produce any degree of cold on the cold side of a Peltier module a large evaporator (or heat sink for dissipating heat) is required on the hot side of the Peltier to evaporate the pumped heat, and thereby reduce the temperature on the cold side, or of a heat sink attached to the cold side (also known as a condenser).

That is to say, because only a certain temperature differential between the hot side of the Peltier device and the cold side of the Peltier device can be achieved for a given voltage applied to the Peltier device, the temperature the cold side of the device can reach is limited by the temperature of the hot side of the device.

To advance the state of the art experimentation was carried forward and tools and equipment produced along with a brief to discover the level of heat which could make the hair malleable. The researchers sought methods to further enhance the effect created by hair irons in general. Several devices were constructed which provided for experimentation with heating and cooling mounted on the same tool. It was found that the use of lower heat reduced the curling or straightening effect and made it less permanent. Whereas, lower heat between 90 degrees centigrade and 160 degrees centigrade would provide the desired result, provided that the imparted heat was removed from the hair rapidly and immediately. The process worked equally well for either straightening or curling.

A similar process provided by an air driven styling tool is described in our patent application GB0711931.6. The experimental irons were provided with tanks through which water was pumped in order to provide a cool surface which the hair may pass over. However, the present invention is not limited to this embodiment. During the curling or straightening process the cool surface temperature ranged between 8 and 20 degrees centigrade, lower temperatures were not used as condensation would be undesirable in the hair manipulation process and would reduce or negate the effect.

One embodiment of the present invention comprises a side by side hair straightener or hair tongs. The tongs comprise of two elements 1, 2, on each one of the inner faces of the tongs there are positioned one heat transfer plate 12 and one cooling plate 11, the opposite member of the tongs correspond to the former matching cold with cold and hot with hot.

That is, the tongs comprise two arms 1, 2, pivotally connected at one end of each of the arms 1, 2. On the inner face of each arm 1, 2, at the opposite end to the pivotal connection (i.e. hinge), there is one hot plate 12, also known as a hot or heated element, and one cooling plate 11, also known as a cold or cooled element. The hot and cold plates 11, 12 are arranged such that when the tongs are closed the cold plate 11 on the inner face of one arm 1, 2 is opposite the cold plate 11 on the inner face of the other arm 11, 12. Similarly, when the tongs are closed, the hot plate 12 on the inner face of one arm 11, 12 is opposite the hot plate 12 on the inner face of the other arm 11, 12. However, the invention is not limited to this number or this particular arrangement of hot and cold elements 11, 12.

Both hot elements 12 and actively cooled elements 11 are separated and are independently controlled but may be integrated to provide a controlled temperature differential between the hot and cold elements 11, 12. That is, although the heating process for the hot element 12 is independent of the cooling process for the cold element 11, the heating and cooling processes may be controlled to achieve a desired difference in temperatures between the hot and cold elements 11, 12. In use the tongs are placed with the cold plates 11 in close proximity to the user's scalp, the operator closes the tongs by putting pressure on the two hinged elements 1, 2 of the tongs, by drawing the tongs through the hair the lock of hair is firstly treated with the hot plates 12 then immediately the cold plates 11. That is, the hair is first heated by the hot plate 12, and then, as the tongs are drawn over the hair, the hair is contacted by the cold element 11 which cools the hair back down. The process provides a more consistent and longer lasting effect than conventional hair straightening irons.

Figure 1:
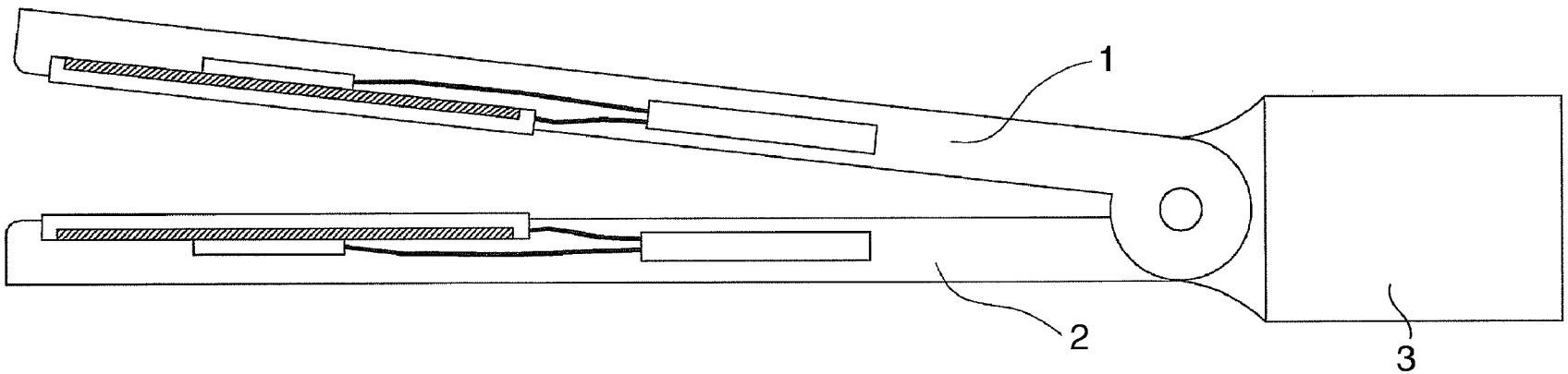
FIG. 1 shows in side view hair tongs, in accordance with a first embodiment of the present invention, in an open position.

In FIG. 1 there is shown a clamping device according to a first embodiment of the invention, comprising of two elements shown as item 1 and item 2, the tongs are in the open position. These two items or elements 1, 2 are also known as arms. The rear portion 3 provides a space for a cooling device.

Figure 2:
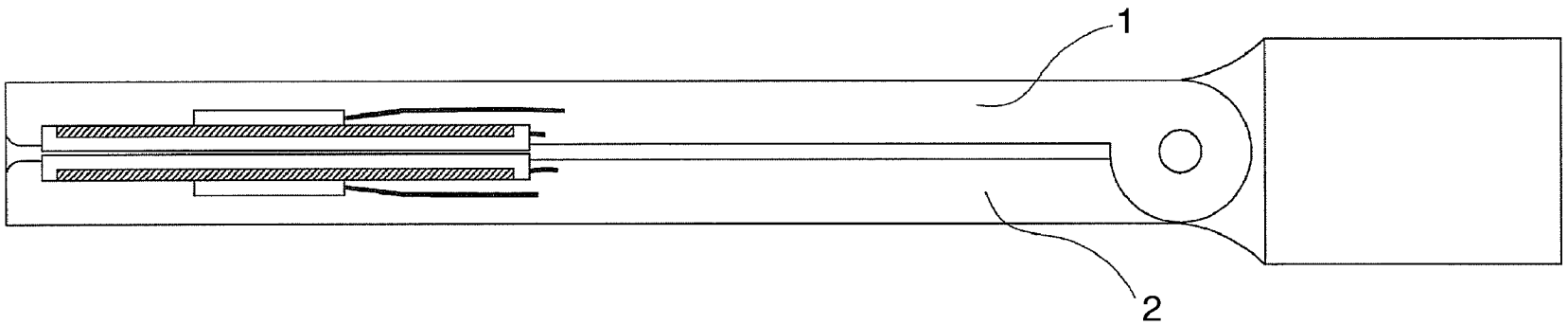
FIG. 2 shows in side view the hair tongs of FIG. 1 in a closed position.

In FIG. 2 there is shown a similar arrangement with the two elements 1 and 2 of the tongs closed and therefore in the clamping position.

Figure 3:
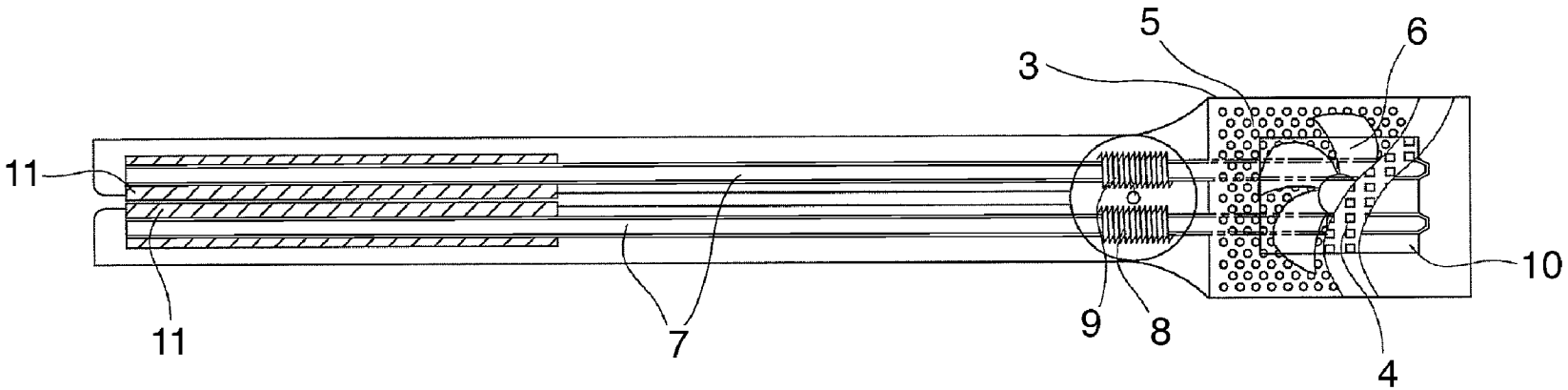
FIG. 3 shows a schematic diagram of the heat transfer system within the tongs of FIG. 2.

In FIG. 3 a side elevation of the cold function of the tong arrangement is shown in a cross section, a suitable conductive material 11 provides an actively cooled surface over which the heated hair passes. In some circumstances it may not be necessary to actively cool the surfaces as the ambient air temperature may be sufficiently low enough to carry out the cooling process. Alternatively where the ambient temperature is warm the tongs are provided with a means of refrigerating the plates 11 this may be provided (but not necessarily the Peltier device as is shown in the present case) with heat tubes or heat pipes 7 to transfer heat from area 11 to heat pipe coupling block 10 via heat pipe flexible joint 8 or 9. Peltier module 4 provides a heat pump effect so drawing unwanted heat to heat sink 5 which is cooled by fan 6.

That is, heat is transferred away from the cooling elements 11 via the heat pipes 7. Heat pipes contain a small amount of liquid coolant, which is evaporated at the hot end of the heat pipe, thereby absorbing heat. The gaseous coolant is cooled at the cold end of the heat pipe, thereby removing heat from the heat pipe and condensing the gaseous coolant into a liquid. The liquid then flows back to the high temperature end of the heat pipe, possibly with the aid of a wick, or by gravitational force, or by capillary action, or by the use of a pump, or any combination of these options.

The heat pipes 7 transfer the heat to the cold side of a Peltier module 4, (also known as a thermoelectric cooler), via the coupling block 10. The Peltier module 4 is a heat pump and transfers heat from the cold side of the Peltier module to the hot side of the Peltier module 4. Heat on the hot side of the Peltier module 4 is transferred to the heat sink 5 which is actively cooled by fan 6, which is a first unit for causing a gas stream to flow. Fan 6 provides a stream of gas, typically air, which passes over the heat sink 5, thereby removing heat from the heat sink 5. As such, heat absorbed at the cooling elements 11 is exhausted from the apparatus as waste heat from the heat sink 5.

Figure 4:
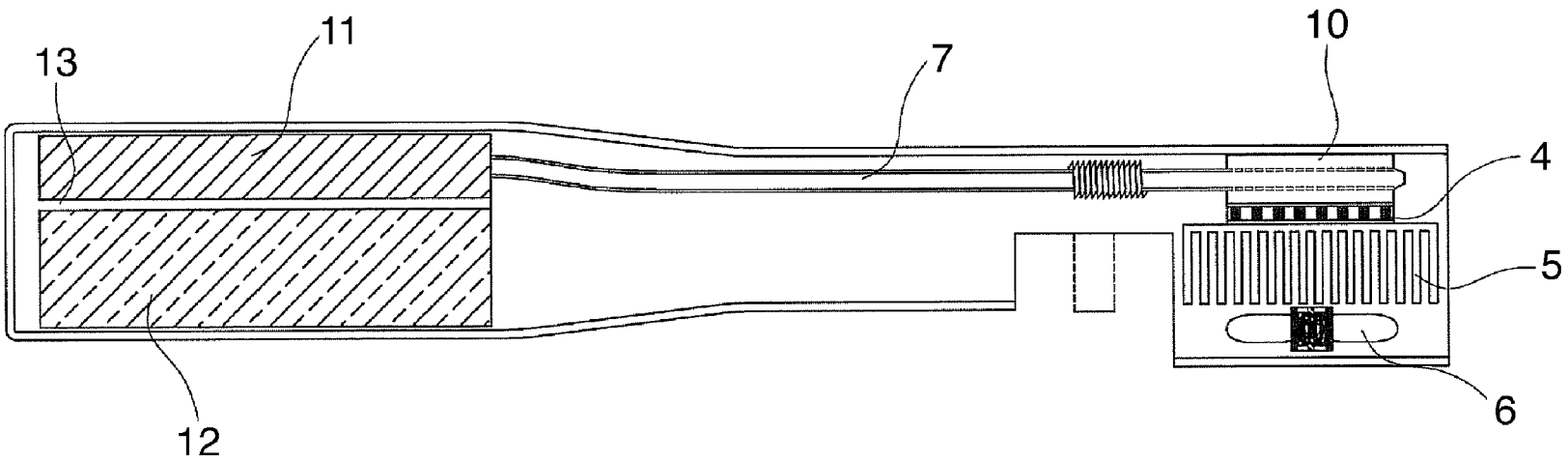
FIG. 4 shows a schematic diagram of the tongs of FIG. 2, as viewed looking towards the inner face of one arm of the tongs.

In FIG. 4 a plan view is shown of one working face of the tongs, a heated plate 12 is arranged immediately adjacent a cold plate 11 providing an uninterrupted route for the hair to pass over, it may be convenient to introduce a hair conditioning agent between the end of the hot plate(s) and the start of the cold plate(s) at position 13. Using conventional tongs can cause damage to the hair. Therefore, it is desirable to apply a conditioning or protecting agent with the tongs to minimise any damage. Of course, the present invention further mitigates against damaging hair by enabling lower temperatures to be used to style and shape hair.

Figure 5:
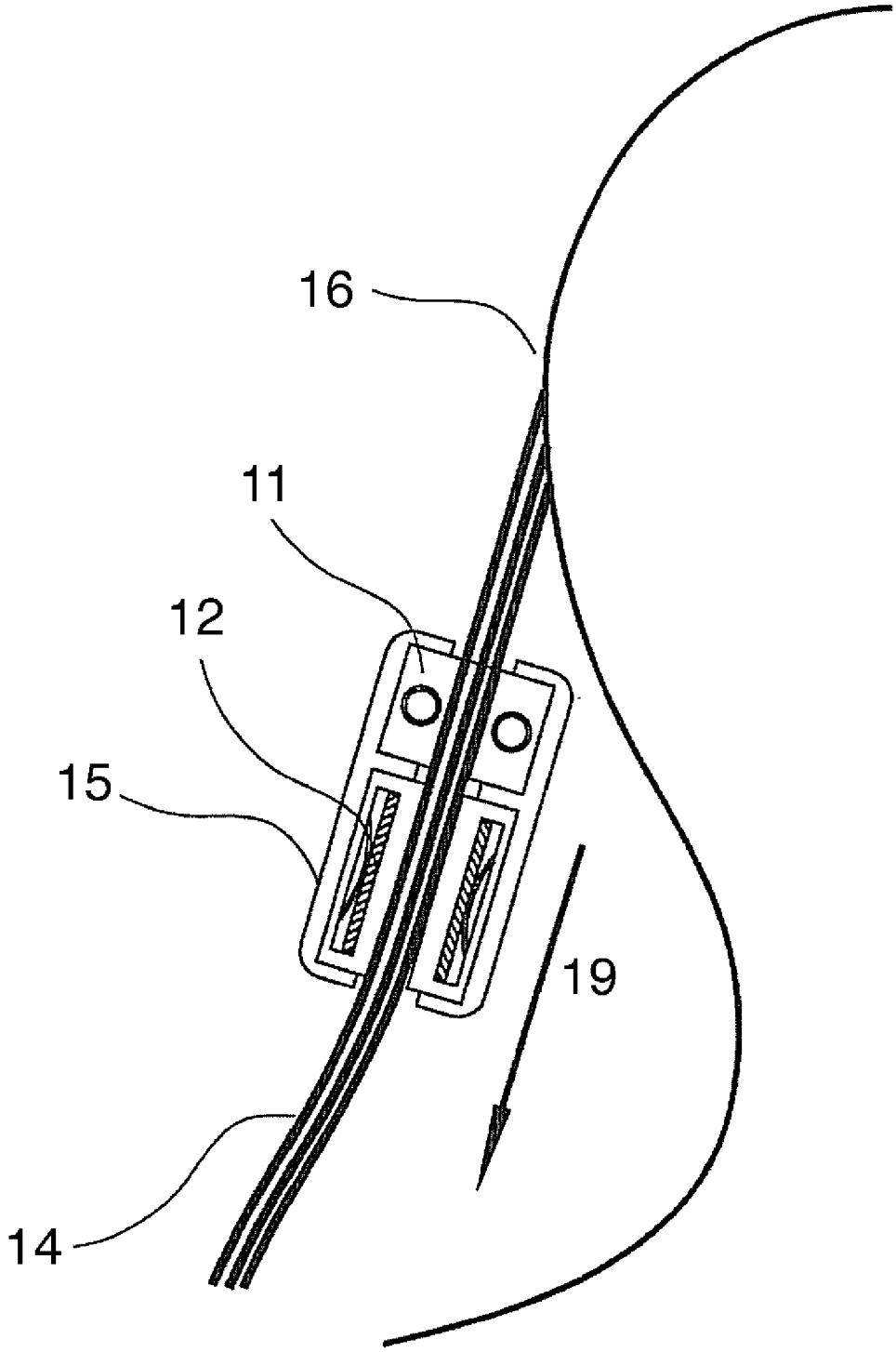
FIG. 5 is a schematic of the tongs of the first embodiment in use.

FIG. 5 shows an illustration of the tongs in practice where the tongs 15 are clamped on to a lock of hair 14 and are drawn from the scalp in direction 19 the hair firstly being heated by element 12 and cooled immediately by cooling element 11 the heated plates freeing the Hydrogen bonds and the cold plates are immediately cooling and fixing the Hydrogen bonds.

Figure 2A:
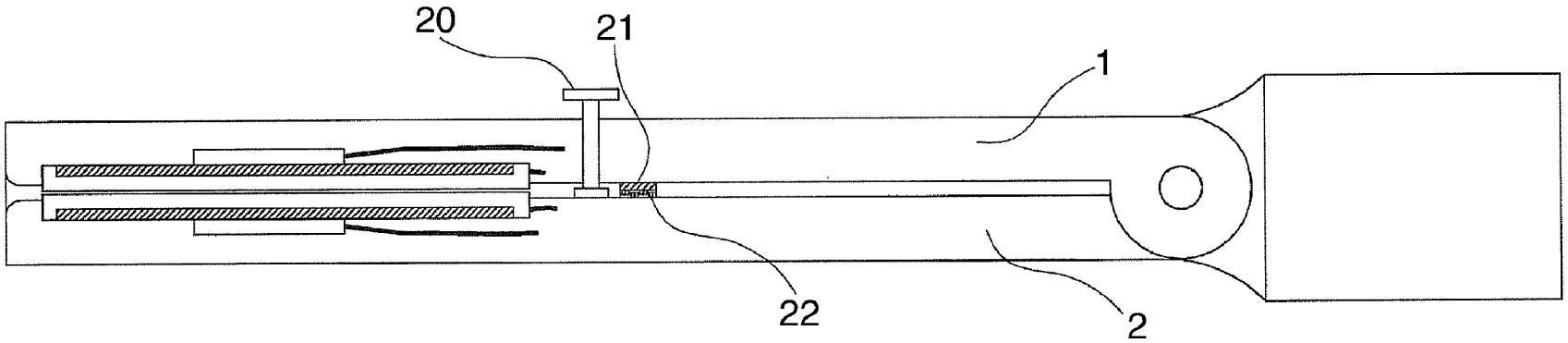
FIG. 2A shows in side view the hair tongs of FIG. 2 further comprising a safety catch.

FIG. 2*a* illustrates a tong arrangement where there is a magnetic holding device, the reason and process is as follows:

Firstly there have been many accidents in the past where children have inadvertently picked up their mother's heated hair straightener and subsequently they have received serious scolding as these tongs are naturally open. Secondly fires have occurred when they have been left unattended. That is, heated hair straighteners which are left on and unattended often heat the casing of the straighteners as well as the hot plate themselves. As such, even if the tongs are left closed, the tongs are able to heat objects that the casing is in contact with, thereby starting fires. In recent years the popularity of hair tongs has also bought on a high incidence of fires and accidents caused by faulty equipment, inadequate thermal fuses, high voltage sparks causing fires where cables have broken from continuous flexing. Young children have been burnt or been scorched by the open Tongs.

What is described in FIG. 2*a* is a set of tongs which are naturally closed, held together with a magnetic catch, only when the tongs are required does the operator release the magnetic catch which opens the tongs assisted by a spring device situated about the tongs hinge area. When the user clamps her hair the magnetic catch engages and remains engaged throughout the process of straightening or curling. The device may be electrically triggered or manually operated or both to open.

The illustration FIG. 2*a* shows the two elements of the tongs 1 and 2 a magnet 22 is attracted to iron 21 release catch 20 provides the mechanical separation.

For the purposes of safety, the iron may be powered by a low voltage 24 v dc power supply to the iron. To augment other electrical supply requirements the tongs are also being provided with a DC to DC converter to power the TEC devices 4 mounted in the tongs as well as the control circuits and PCB.

It is envisaged that further development may provide further electronic facilities to be transferred off the tongs to be accommodated in the tongs power supply or positioned on the cable supplying the tongs.

Figure 6:
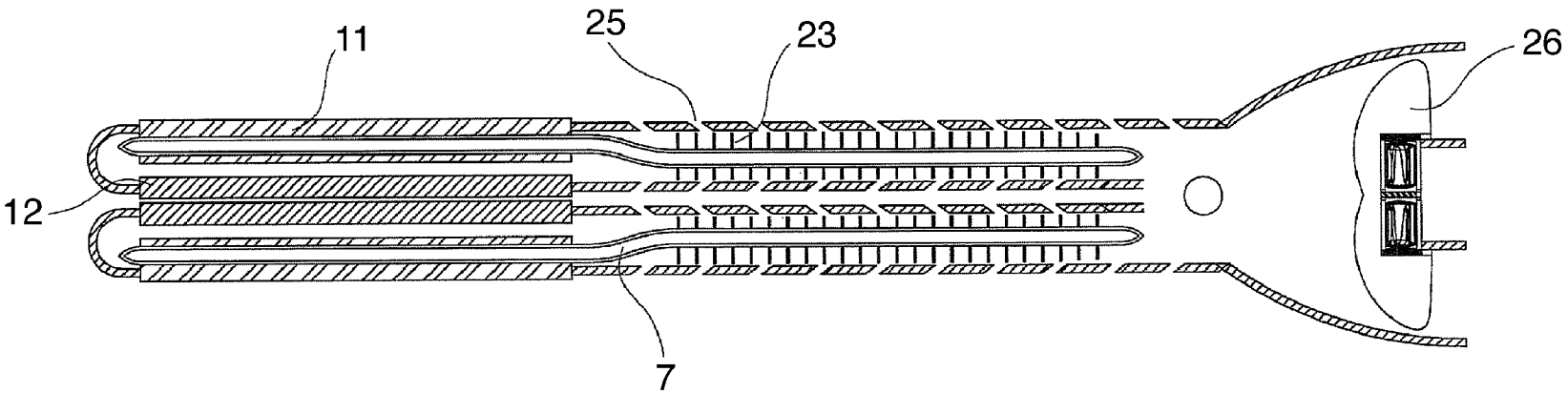
FIG. 6 shows in side view hair tongs in a closed position in which a cooling element is positioned on the outer surface of the tong casing.
Figure 8:
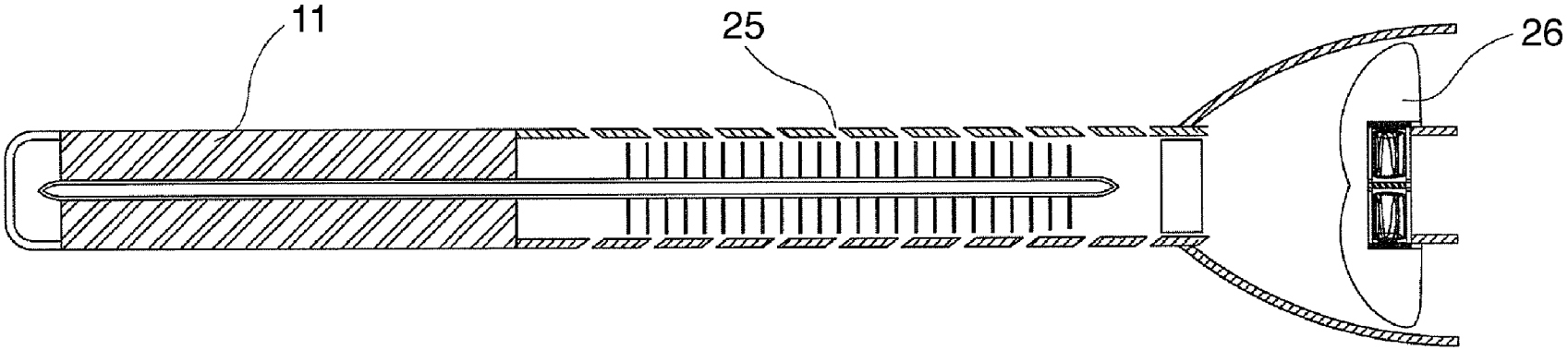
FIG. 8 shows a schematic plan view of the tongs of FIG. 6, looking towards the outer cooling face of one of the tong arms.

FIG. 6 illustrates an alternative arrangement where a hair straightening tong is provided with conventional heated plate 12. That is, heated plates 12 may be heated by a heater, such as an electrical resistance heater. In advance of conventional devices, a cooling plate 11 is provided on the reverse side of tong this may be manufactured from aluminium or other thermally conducting material. That is, the cooling plates 11 are provided on the reverse side of the tong arms to the heated plates 12, so that the cooling plates are on the outer surface of the tongs when the tongs are in a closed position. FIG. 6 (side view) shows cooling plate 11 being provided with a heat pipe 7 to which cooling fins 23 have been added, cooling air is drawn in through air entry holes 25 by the suction provided by fan 26. FIG. 8 illustrates (in plan view) the extent of the cold plate. It can be seen in FIG. 8 that the cold plate 11 reaches from one side of the tong face to the other. This ensures the maximum area for cooling. In some embodiments, the cooling surface may also extend around the side of the face, to provide a larger surface area for cooling the hair.

Figure 7:
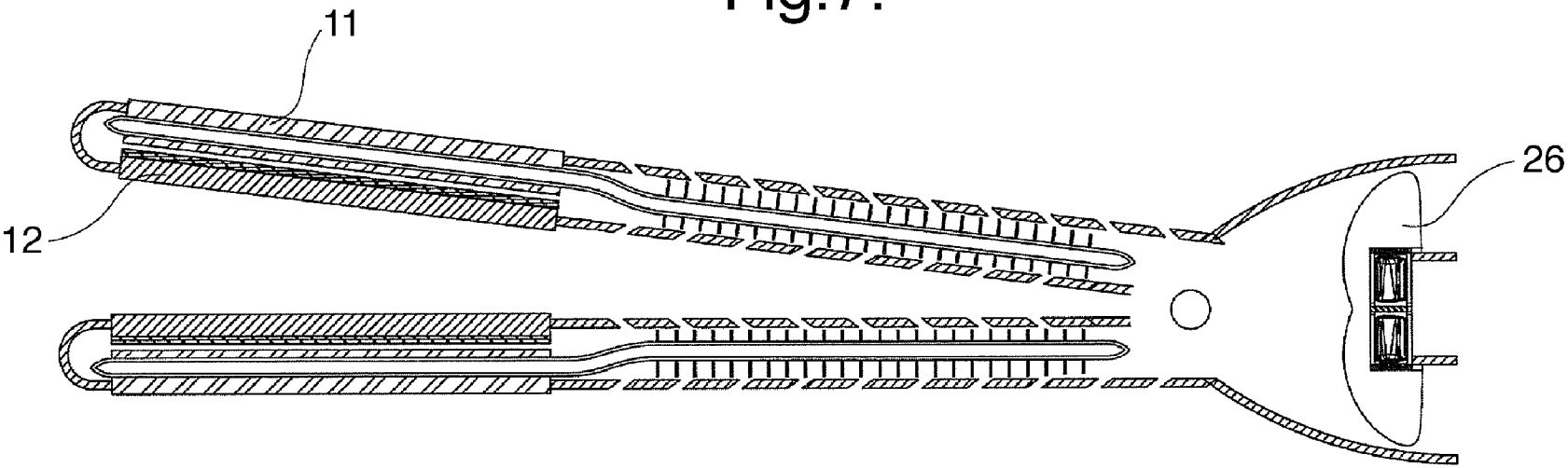
FIG. 7 shows in side view the tongs of FIG. 6 in an open position.

FIG. 7 shows the tongs of FIG. 6 in an open position.

Figure 10:
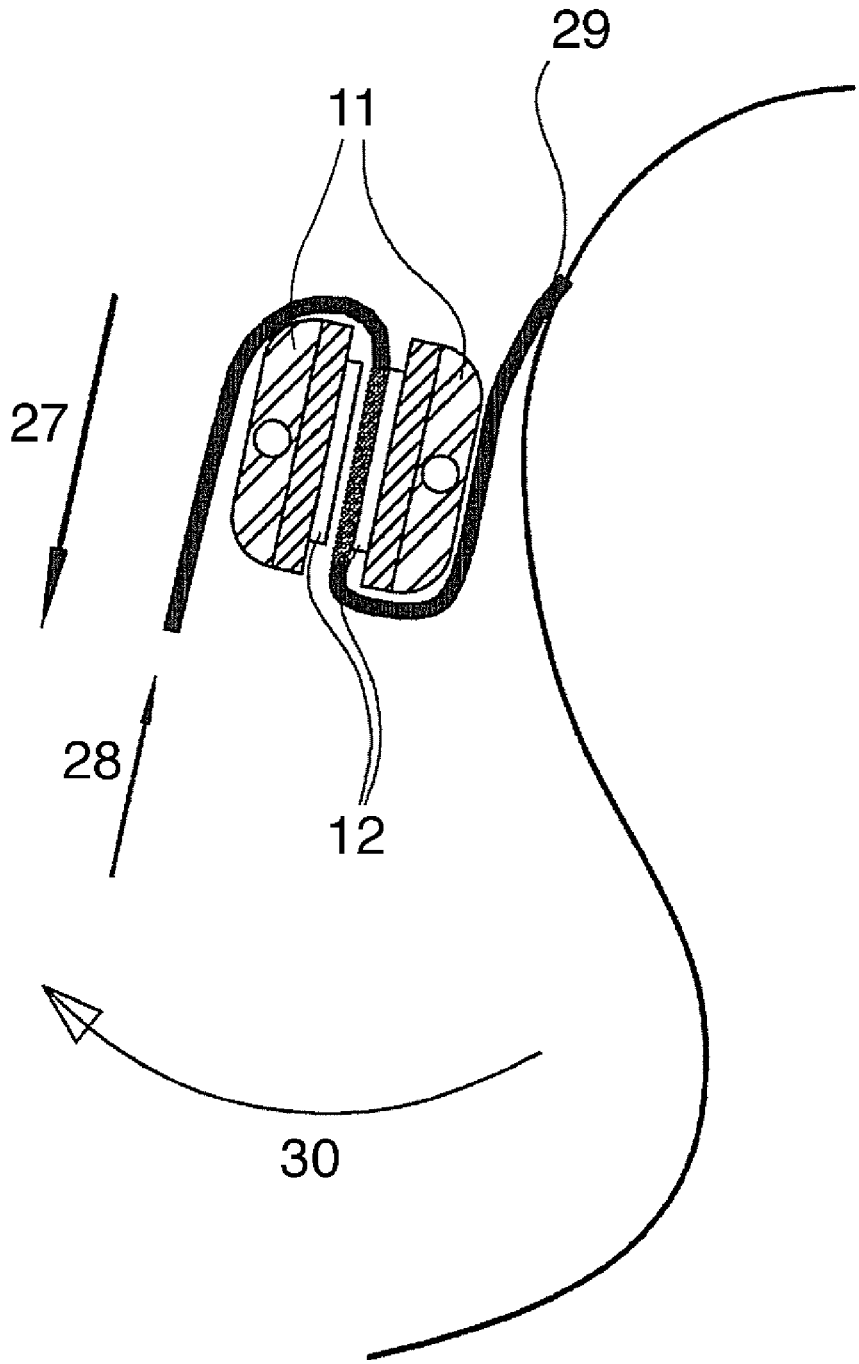
FIG. 10 shows the tongs of the second embodiment of the present invention in use.

In operation, the tongs of FIG. 7 are opened and the hair is arranged as shown in FIG. 10 where hair locks 29 are placed between tong heating elements 12. As shown in FIG. 10, the operator closes the tong jaws and rotates the tongs in direction 30 the tongs are drawn in direction 27 the untreated hair travelling in direction 28 where the hair 29 is dragged over the cooling plates 11. This process heats the hair and then immediately cools the hair into a new shape such as a curl.

Figure 9:
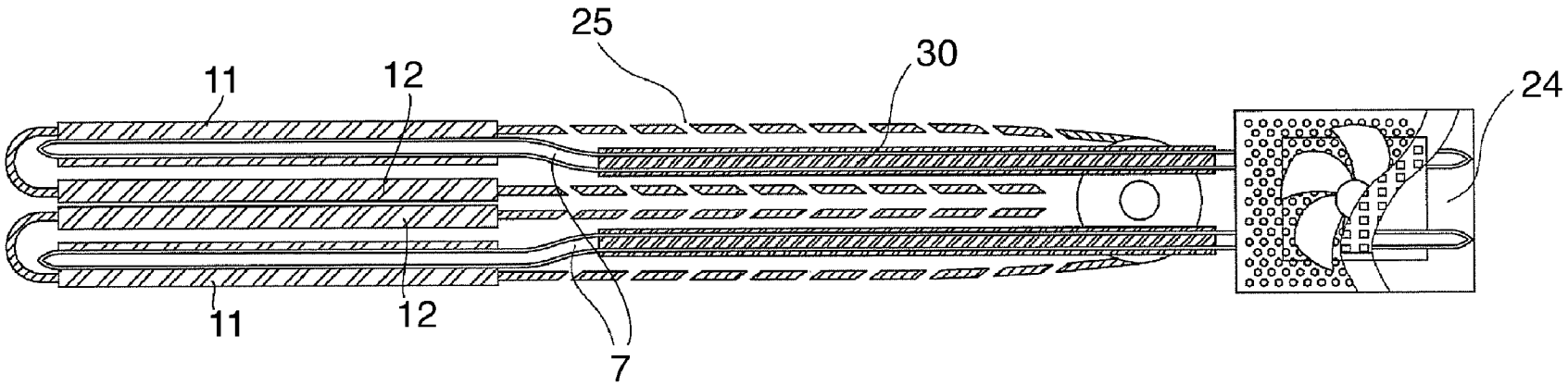
FIG. 9 shows a schematic view of hair tongs in accordance with a second embodiment of the present invention, in which the cooling plates are on the outer casing of the hair tongs.

An alternative arrangement is illustrated in FIG. 9 where a similar set of tongs is provided with an active cooling unit 24, in this case a Peltier module combined with a fan cooled heat sink. Heat pipes 7 are insulated 30 against the effects of ambient heat. In this second embodiment of the invention, the heated plates 12 are heated by, for example, an electrical heater. Heat is transferred to the cooled plates 11 via the heat pipes 7 to the cooling unit 24. As in the embodiment depicted in FIG. 4, the cooling unit may comprise a heat pipe coupling block 10 in thermal contact with the cold side of a Peltier module 4. A heat sink 5 may be mounted on the hot side of the Peltier module 4 transfers heat to an air stream which is caused to flow across the heat sink by a fan 6.

Figure 11:
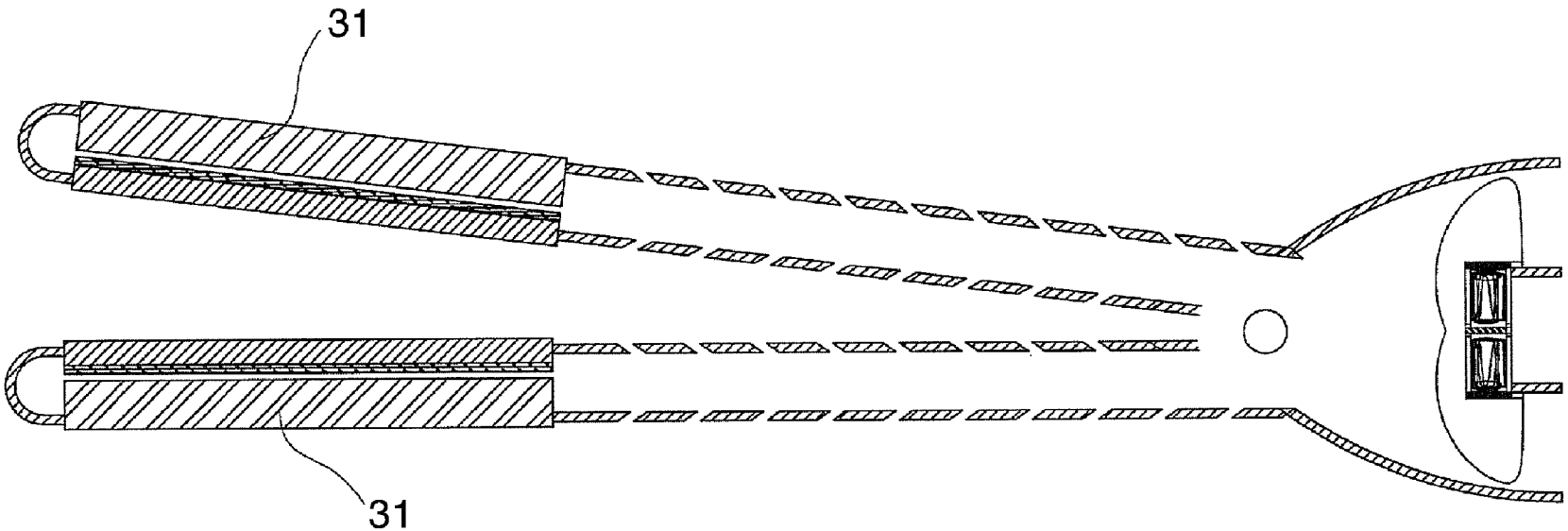
FIG. 11 shows a schematic side view of tongs in which the cold storage plates are attached to the tong device by a quick release retaining device.

FIG. 11 illustrates an alternative method of providing the cooled surface, two cold storage plates or containers 31 filled with a suitable liquid, or suitable cold retaining material are pre-cooled prior to attaching the tong device by a quick release retaining device. The removable cooling plates or containers are previously cooled by an off tong device to the correct temperature, approximately 10 to 15 degrees centigrade by a regulated refrigeration device, an example would be conveniently designed Peltier powered refrigeration unit which may be mains electricity powered or battery powered.

The previously described embodiments of the invention have the active cooling unit provided at a distance to the cold plate or the element being cooled. The cold plate is connected to the cooling unit 24 via a heat pipe 7. This arrangement is advantageous because space in the tongs at the end for transferring heat to and from the hair is at a premium. Therefore, the cooling unit 24 can be positioned away from this end and connected to the cold plate by the heat pipe.

However, the invention can also be put into practice with the Peltier module in closer proximity to the cold element using heat pipes to transfer heat from the hot side of the Peltier unit to the active cooling device. This maintains the advantage of keeping the active cooling unit 24 (including the heat sink 5 and fan unit 6) at a distance from the heating and cooling plates 11, 12, whilst allowing for improved heat transfer away from the cold plate 11. FIGS. 12-18 depicts hair tongs according to this embodiment of the invention. This embodiment further comprises improvements to the size and efficiency of the cooling system. Due to the confined space available within the internal cavity of the each arm of the tongs, this embodiment comprises a design for a compact evaporator with high efficiency which will conveniently fit into the available space.

A typical layout of components would have a condenser or heat sink 63 to collect heat, a Peltier module 64 and evaporator or heat sink 32 with a heat resistance of 0.1° C./W with a typical cooling fin surface area in the order of 30-1, relative to the contact surface size of the Peltier module 64. However, the present invention is not limited to these components, or components with these specifications. The reversal of current through the Peltier module 64 will have the effect of generating heat as apposed to cold, the evaporator becoming the condenser of low grade heat and the evaporator delivering the compressed heat.

Conventional hair tongs provide two heated surfaces positioned between the two elements of the tongs. These devices are relatively simple in construction and do not require very complex temperature control electronics. In contrast, the previously described tongs require two sets of hot and cold electronic systems, one to control the cold plate, and another to control the hot plate.

In order to accommodate the required components in the confined space of the body of the tongs, specifically designed components are required. Heat sinks with a low thermal resistance had to be innovated as there were no available designs able to provide the high performance that was desired e.g. 0.1° C./W to remove 20 to 35 watts of heat from the tongs' condensers (i.e. the heat sinks on the cold side of the Peltier module), and also maintain a steady temperature of 12° to 15° at the condenser where the hair is cooled after heating and shaping.

Figure 12:
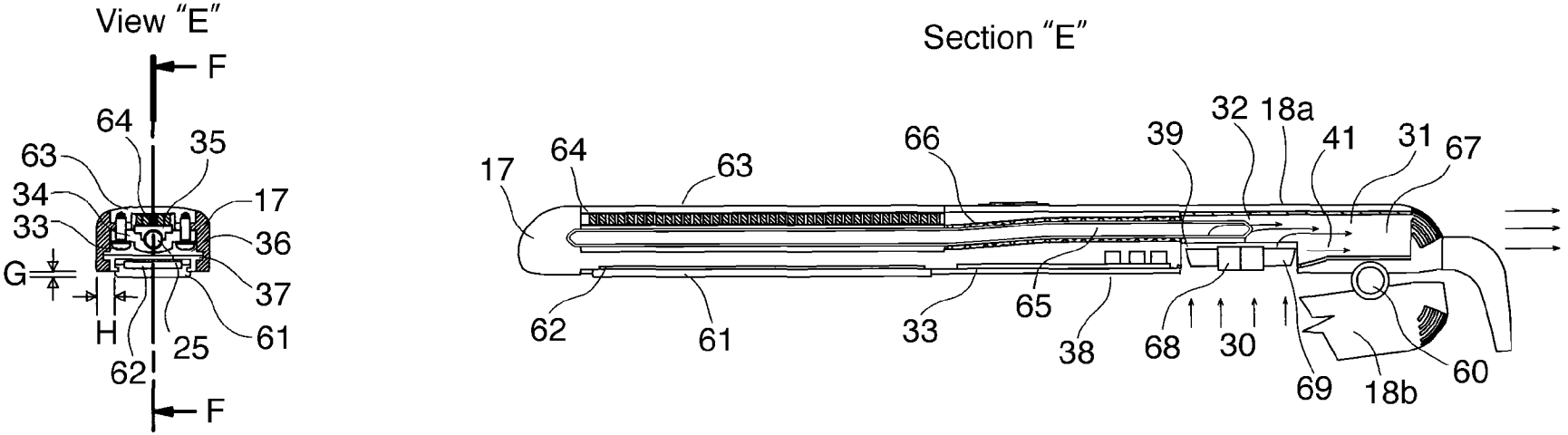
FIG. 12 shows cross-sectional views through one arm of hair tongs according to a third embodiment of the present invention.

FIG. 12 shows two cross-sections through one arm of hair tongs in accordance with a third embodiment of the present invention. A longitudinal side view through cross section "F" is shown in section "E". The tongs comprise an outer cover and chassis 17 of the tongs, there being two separate tong arms 18*a* and 18*b*, arm 18*b* shown cut off near the hinge point 60, for ease of describing the various components. It may be assumed that arm 18*b* contains similar components to its mated pair 18*a*. Plate or element 61 is heated by ceramic heater 62 both parts being mounted in sub frame 37 which is under sprung (springing not shown) in body 17 as a means to provide parity between the two mirrored heated plates positioned in both the tong arms 18*a* and 18*b*.

The arrangement also provides for the minimum amount of heated plate 61 being exposed from a side on perspective. Exposed distance G is approximately 1 mm above the body 17 in preferred embodiments providing sufficient clearance for hair to pass though, but being sufficiently small not to expose a child's fingers to the heated plate 61 when the tongs are closed. However, the invention is not limited to this tongs with this clearance. Distance H also provides a further restrictive barrier between the outer body 17 and the hot plate 61 to prevent a child's small fingers being exposed to burning, in the event of a child attempting to handle the tongs.

Insulation 36, preferably in the form of nanofoam, is placed between the hot and cold elements to reduce temperature leaks. The condenser 63, which functions as a cold element, is positioned on the outside of the tong casing 17, and is set into the outer structure of the tong arms 18*a*, 18*b*. This provides a continuous surface to ensure that hair passing over the surface is in good contact with the outside of cold element 63. Condenser 63 is machined internally to provide an accurate surface fit with TEC 64. Sintered heat pipe 65 is mounted into compression fitting 35, which is provided with a precision mounting surface to the underside of the TEC 64. Condenser 63, TEC 64, and saddle clamp 34 and 35 are held together with fixings 33. Heat pipe compression fitting 35 ensures good parity with heat pipe 65, which is for heat conductance to the heat pipe. Heat pipe 65 rapidly removes heat to the evaporator 32.

The heat pipe 65 is insulated by insulation 66 to avoid unwanted heat transmission and also ensure that the transferred heat reaches the evaporator 32. The insulation 66 also prevents undesirable heat reaching the systems electronics and the DC to DC converter 33.

The evaporator 32, which is a heat sink for transferring heat from the hot side of the TEC 64 to the surroundings, is positioned to intake clean cooling air from between the two inner faces 30 of tong arms 18*a* and 18*b*. Air is driven into the evaporator 32 via fan 68 which is axially positioned at 90° to the inner face 38 of arm 18*a*. As shown in FIG. 13, evaporator 32 with its embedded fan 28 comprises a number of generally "U" formed copper fins 67, or fins formed from similar highly conductive materials. A plenum chamber is formed between the body cavity of the tong arm 18*a* (tong arm 18*b* also having a similar but separate arrangements) and the evaporator fins 67.

The evaporator this 67 are engaged into conveniently moulded slots on the internal face of the tong arms 18*a* and 18*b*. The axial fan 68, and the outer element of the evaporator 40 define the closed end of heat sink 32. Air from the fan is compressed in the plenum chamber 39 and cooling air exits in the direction of arrow 41 in FIG. 12.

The general fin arrangements 67 are attached to heat pipe 65 by compressive punching and swaging of the fins 67, which are in turn pushed on to the heat pipe 65 at the desired spacing conveniently provided by the depth of the swaged flange during manufacture.

Compressed air/gas is circulated in the direction of arrow 31 travelling longitudinally in the direction of arrow 41 at the rear of the tongs. The fan blade 69 may also be provided with a means of radial flow to assist in further dispersal of the air through the sink.

Figure 15:
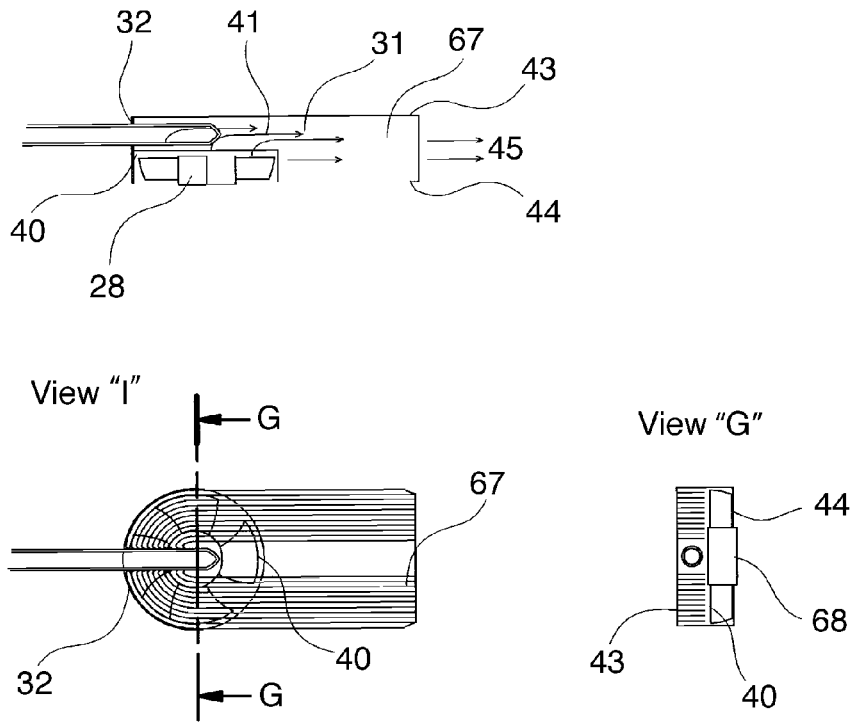
FIG. 15 is a side, plan and end view of a heat sink for cooling the hot side of the heat pump device used in the tongs of either the third or fourth embodiment.

FIG. 15 is an illustration of a "U" shaped evaporator in isolation from the body 17, the design in FIG. 15 is provided with two enclosure plates 46 and 44. View "I" shows the cooling fins of the sink exposed. In general the fin arrangement 67 may be spaced to compliment the performance of a chosen fan: for instance, a smaller slow running fan would require less fins spaced wider apart, but would provide less cooling capacity than a more powerful fan acting on a greater amount fins that are arranged in closer proximity to one another but would provide increased cooling.

The heat sink or evaporator 32 comprises of a multitude of fins 67 generally formed in the shape of the letter "U". The outer limits of the heat sink 32 have the largest fin area with a plurality of similar shaped fins arranged in descending scale to fit within the largest outer fin enclosure. A convenient gap is provided between each fin 67 to facilitate air movement. Heat is transferred to the evaporator 32 by a sintered heat pipe 65. Each fin 67 is mounted on the heat pipe 32 via a punched and swaged flange, formed to create a press fit between the heat pipe 32 and each fin 67. Cooling air is provided by frameless axial fan 68 positioned within a cavity in the evaporator 32. The air is directed down the vertical axis as well as radially outwards. The casing of the tongs, or a provided base plate forms the base of the heat sink 32. The arrangement forms a plenum chamber 39 consisting of the three sided restricted cavity created by the outer fin 67 and the casing of the tool. The fan 68 impellor blades may be designed to release air both axially and radially, this type of air flow may be facilitated by modifying the outer tips of the blades to spill air radially similar to a radial blower.

FIG. 16 illustrates an alternative version of an evaporator and fan arrangement, in this case two separate evaporators 45 are provided, to form a single overall heat sink split into two clusters of generally shaped "U" sections cooling fins 50 which may be attached to one or more heat pipes 65 by compressive punching and swaging. The cooling fins 50 are pushed onto the heat pipe 65 to enable a tight fit. Cooling fins 50 are arranged with the outer fins 48 forming a longitudinally barrier. Enclosure plate 46 may be placed over the two evaporators 45 in place of the body of the tongs to form the plenum chamber 47. Positioned in base of the plenum chamber are cooling fins 50. The fan 68 compresses the ambient air into the galleries 51 formed by the fins 50.

In the alternative heat sink and fan arrangement, where two sets of generally 'U' shaped fins clusters 45 are assembled on a heat pipe 65, the base of the "U" shapes are positioned in close proximity to one another. As such, the air exit points are opposed to one another. This arrangement reduces the requirement for a noisy high pressure axial fan as the distance from the plenum chamber to the air exit is reduced considerably.

Figure 17:
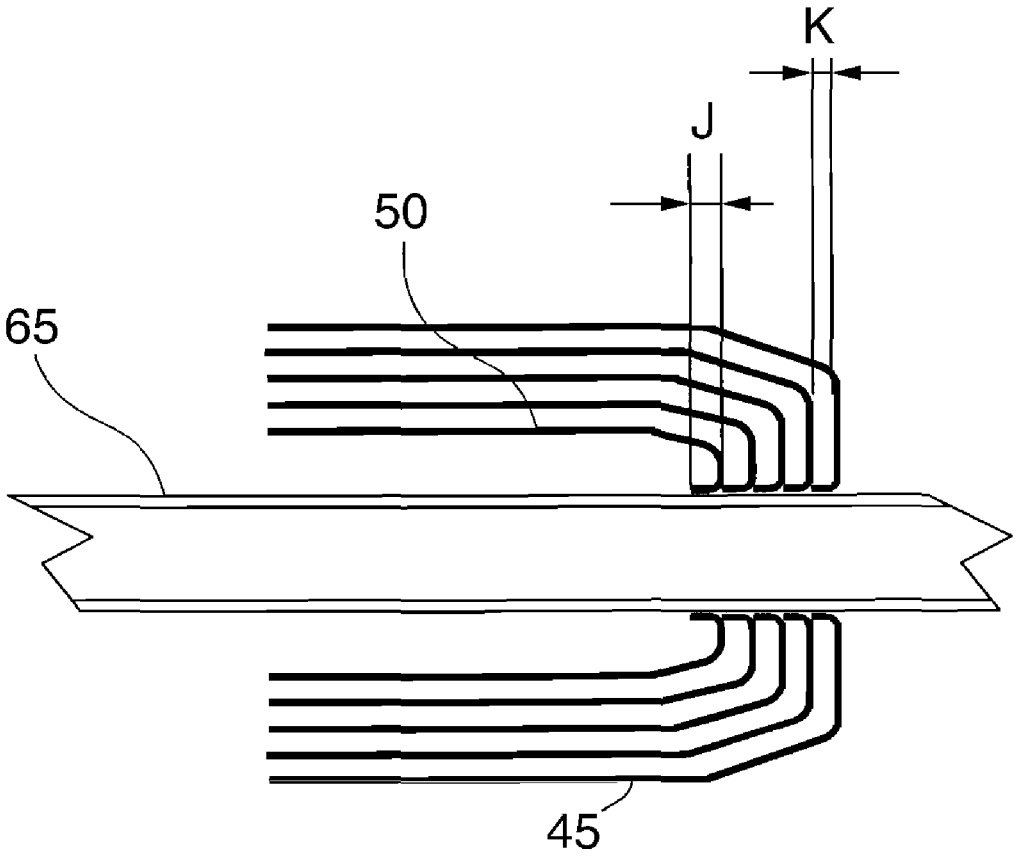
FIG. 17 shows a cross-section through the heat sink of FIG. 16.

FIG. 17 shows a cross section of the evaporator 45 and heat pipe 65, in greater detail. It has been found that to transmit heat from heat pipe 65 to the evaporator 45 efficiently, the swaged flange measurement J must be at least the distance K or greater than K, where K is the gap between adjacent cooling fins 50. However, the present invention is not limited to this condition.

FIGS. 18 and 18*a* illustrate a similar arrangement to FIGS. 12 and 13, but the single evaporator has been replaced with a double evaporator type shown in detail in FIG. 16.

In FIGS. 18 and 18*a* double evaporator 45 is contained within body casing 17 and is attached to heat pipe 65. The double evaporator 45 provides two air exit routes: 41 to the rear, and 31 passing over the PCB and dc/dc converter 38. Air with a temperature which has risen approximately 1° C. above ambient flows over converter components 38 and the air flow reduces component temperatures from 80° C. down to a suitable running temperature. This results in greater longevity of the components 38. The air flow exits at the exit point 39. That is to say, the arrangement of the fins of the heat sink 45 provides a cooling flow over the electronic components within the tongs, thereby preventing any heat damage to those components.

Figure 14:
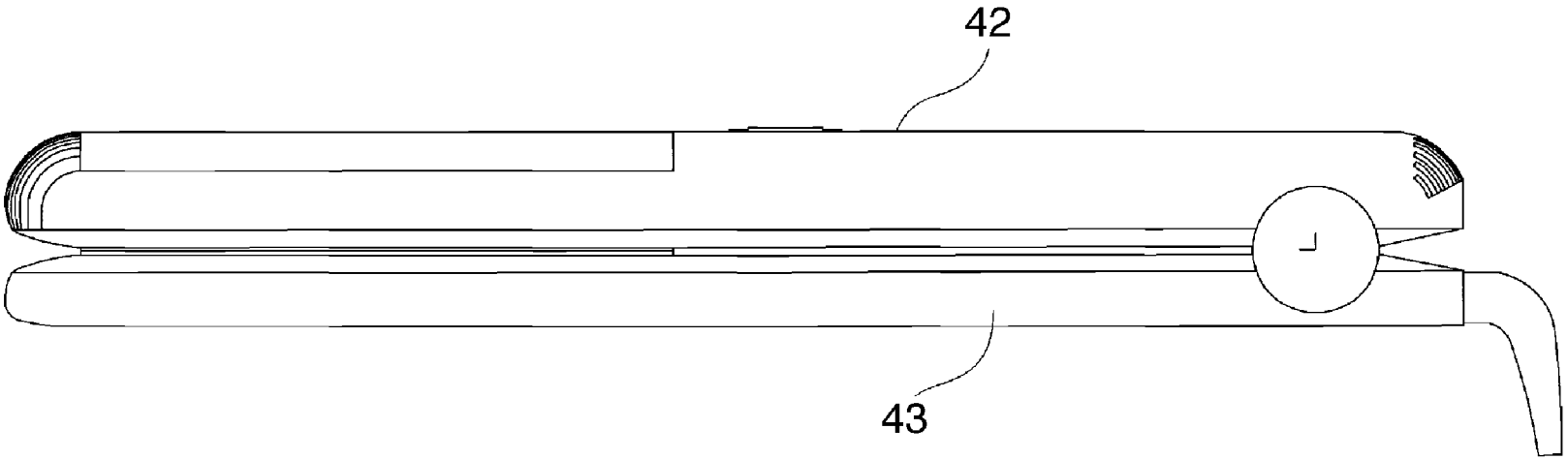
FIG. 14 shows in side view hair tongs according to a fourth embodiment of the present invention, wherein one arm of the tongs is provided with a cold exterior face.

FIG. 14 shows an alternative version of the tong arrangement where only one arm 42 of the tongs is provided with the actively cooled cold exterior face and the interior is provided with a heated plate. The second arm 43 is provided with only with a heated plate which is encased in nanofoam on the non working surfaces. This lessens the escape of heat to the casing. The single cold arm provides a lighter less costly tool to construct, but still retaining the hot and cold hair processing capabilities.

FIGS. 19-21 depict an embodiment of the present invention, in which the present invention is used in a hair dryer.

Present state of the art Hot and Cold air delivery devices show the use of separate and common ducting both being contaminated by residual heated air. Devices such as that in U.S. Pat. No. 5,507,103 can only perform a limited amount of heat transfer from the air flowing over the cold side of the Peltier device to air flowing over the hot side of the Peltier device. This is because the air is flowing relatively fast. Further, the device is specifically constructed such that heat can flow from the hot side of the Peltier device to the cold side of the Peltier device to try and keep the temperature differential across the Peltier device as close to zero as possible.

According to this embodiment of the invention, a hot air stream is provided by a fan 78 which is a first unit for causing gas to flow. Fan 78 causes a first stream of air to flow over heater 80 and out of duct 93. This operation also causes air to flow over the heat sink 72 which is connected via heat pipe 97 to the hot side of Peltier module 74 which is a heat pump.

Peltier module 74 is turned on whilst the heated air stream is being produced, such that heat sink 73, which is attached to the cold side of the Peltier module 74, is cooled and heat is transferred via the Peltier module 47 to heat sink 72 and then to the air stream being forced to flow by fan 78. When a blast of cool air is required, fan 78 is stopped, and fan 79 is started. Fan 79 is a second unit for causing gas to flow. Fan 79 causes a second stream of air to flow of air over heat sink 73, which has been cooled whilst fan 78 was operating. Therefore, the air forced to flow over heat sink 73 is cooled and exits out of duct 94. As such, the air forced to flow by fan 78 is immediately cooled, and at no point mixes with the heated air which previously was exiting from duct 93. That is, the user can select for one or other or both of the first and second gas streams flow. This is the same as the tongs embodiments, in which an air or gas stream flows over the heat sink on the hot side of the Peltier modules when the cooling system is turned on. In the present embodiment, selecting the first air stream to flow over the heat sink 72 produces a heated air stream, which is further heated by the heater 80. However, in some applications, where the temperatures required for hot processing are not so high, a further heater may not be necessary.

The first and second stream of air have separate inlets and outlets, and do not mix. This results in an instantaneous change of temperature. Similarly, when it is desired to change back from cold air to hot air, fan 79 is stopped and fan 78 is started resulting in an immediate change to a hot air flow.

In FIG. 19 there is shown a sectional side view of the device showing body 71 provided with insulation in areas 88 and 77. FIG. 2 shows a cross sectional view of insulation 48 between and around cold duct 91 and hot duct 92 which ensures the integrity and separation of the cold and hot areas of the body 71. In FIG. 1 body 71 is provided with two defined outlets 71 and 72. Duct area 76 is provided with a large sink 72 having approximately 40 times greater surface area than the cold storage area 73.

A TEC module 79 draws heat from the cold storage sink/storage device 73 which is then evaporated via the large heat sink 72. The cooling of the evaporator is increased by fan 78. The same air carrying a rise in temperature after travelling through the sink 72 is heated further by heated ceramic plates 80 before exiting at nozzle point 81.

Cold sink and storage device 73 is contained in separate, insulated duct 75 which is conveniently mounted on top of body 71. The operator may conveniently change from the hot to cold supply by simply engaging the device's cold button, which stops the air flow through the hot duct 76 and switches on fan 79 in cold duct 75.

That is, the device consists of two main ducts 75, 76, the main duct 76 which feeds the hot air requirement and a smaller duct 75 which supplies the cold requirement. Hot air is provided by the air steam flowing over a ceramic heating element 80, and cold air is generated by utilising the ambient air stream travelling through the main duct to cool down an evaporator or heat sink 72. The evaporator is conveniently connected to a Peltier module 79 via heat pipes 97 to evaporate heat from the hot side of the Peltier module 79. The cold side of the Peltier module 79 is provided with a condenser or heat sink 73 which is cooled. In operation the condenser is cooled well below ambient temperature storing the necessary cold supply for the device. The process is continuous while power is switched to the Peltier module.

The cold duct 75 is provided with its own high pressure fan 79 which may be switched for a short burst or for greater period of time.

It may be convenient to reverse and control the fan speed in the hot duct 76 to ensure that hot air remains in the duct 76 and does not contaminate the flow of cold air 83 and 84 from the cold duct 75

To avoid a Venturi effect the outlets of both cold and hot ducts 81 and 82 are provided with air flow disrupters 90 as shown in FIG. 21. Small amounts of turbulence are created by flow disrupters 90 where the Venturi effect is likely to occur. That is, the flow disrupters 90 stop air from one duct 81, 82 being drawn out when air is flowing through the other duct 81, 82. This avoids contamination of the flowing stream with unwanted hot or cold air. To facilitate ease of use the devices nozzles 81, 82 are manufactured to afford convergence of delivered hot and cold air 93, 94 at a working distance. However, the blow dryer may be provided with adjustment foils 95, 96 for both nozzles to increase or decrease this working distance.

Due to great variations of temperature, it is possible undesirable condensation will occur within the cold generation duct. To avoid condensation being carried in the cool air flow, the device is provided with an automatic drying cycle by utilising the hot to cold, or cold to hot capabilities provided by the Peltier module 79. This reversing of the temperature generation is instigated by simply the reversing of the voltage which powers the Peltier module 79. As stated this action will also reverse the temperature in both sinks 72, 73. As a result the temperature in the cold storage area is raised, to ensure that no moisture is present when the device is switched off, or if undesirable amounts of moisture accumulate in the cooling duct or its component. Further the dehumidifying operation may be facilitated after the main switch is switched off on the tool by a timing device which automatically reverses the direction of the current to the TEC for a small period of time.

The invention claimed is:

1. An hair tongs for hot and cold processing, for cooling hair during styling, the hair tongs comprising:

a heat pump configured to transfer heat from a first part of the heat pump to a second part of the heat pump, thereby cooling the first part of the heat pump for cold processing;

a first heat sink arranged to be in thermal contact with the second part of the heat pump such that heat may be transferred from the second part of the heat pump to the first heat sink and thereby cool the second part of the heat pump; and at least one heat pipe for one of either transferring heat from the second part or transferring heat to the first part of the heat pump;

wherein the hair tongs perform cold processing at a temperature from approximately 8° C. to approximately 20° C. wherein the at least one heat pipe is disposed in at least one arm of the hair tongs.

2. The hair tongs according to claim 1, wherein the first heat sink is in thermal contact with the second part of the heat pump via the at least one heat pipe.

3. The hair tongs according to claim 1, further comprising:

a component arranged in thermal contact with the first part of the heat pump, such that heat is transferred from the component to the first part of the heat pump.

4. The hair tongs according to claim 3, wherein the first part is in thermal contact with the component via the at least one heat pipe.

5. The hair tongs according to claim 1, further comprising:

a first unit for causing a first gas stream to flow across the first heat sink and thereby transfer heat from the first heat sink to the first gas stream.

6. The hair tongs according to claim 5, wherein the first unit is configured such that the first gas stream does not transfer heat to the first part of the heat pump, or wherein the first unit comprises a fan arranged to cause the first gas stream to flow across the first heat sink.

7. The hair tongs according to claim 5, wherein the first heat sink comprises a plurality of fins.

8. The hair tongs according to claim 1, wherein the apparatus is for hot processing at a temperature from 90° C. to 160° C.

9. The hair tongs according to claim 1, further comprising:

a heater for providing a source of heat for hot processing.

10. The hair tongs according to claim 1, wherein the heat pump is a thermoelectric cooler.

11. The hair tongs according to claim 1, wherein the surface area of the first heat sink is at least 30 times greater than the surface area of the second part of the heat pump.

12. The hair tongs according to claim 3, wherein the component is a first element with a surface for contacting with hair.

13. The hair tongs according to claim 12, further comprising:

a second element for being heated, wherein the second element has a surface for contacting with hair.

14. The hair tongs according to claim 13 wherein at least one of the first and second elements is a ceramic plate.

15. The hair tongs according to claim 1, wherein the tongs further comprise two arms pivotally connected to each other, wherein the arms are positionable in a closed position.

16. The hair tongs according to claim 12, wherein the first element is positioned on a first one of the two arms such that the surface for contacting with hair of the first element faces away from the second one of the two arms when the tongs are in the closed position.

17. The hair tongs according to claim 1, wherein the hair tongs include a hot and cold gas blower.

18. Hair tongs, comprising:

an element with a surface for contacting hair;

a heat sink;

a thermoelectric cooler, in thermal contact with the element and the heat sink; configured to transfer heat from the element to the heat sink, thereby cooling the element; and a fan arranged to cause gas to flow over the heat sink, thereby removing heat from the heat sink, further comprising at least one heat pipe, arranged such that heat is transferred from the element to the thermoelectric cooler.

* * * * *